US008223022B2

(12) United States Patent
Skjellerup et al.

(10) Patent No.: US 8,223,022 B2
(45) **Date of Patent: *Jul. 17, 2012**

(54) SECURITY TAG ASSEMBLY

(76) Inventors: Johan Skjellerup, Boca Raton, FL (US); Eddie L. Stenild, Dragor (DK)

( * ) Notice: Subject to any disclaimer, the term of this patent is extended or adjusted under 35 U.S.C. 154(b) by 0 days.

This patent is subject to a terminal disclaimer.

(21) Appl. No.: 12/940,717

(22) Filed: Nov. 5, 2010

(65) Prior Publication Data

US 2011/0050427 A1 Mar. 3, 2011

Related U.S. Application Data

(63) Continuation-in-part of application No. 12/316,586, filed on Dec. 12, 2008, now Pat. No. 7,817,041, which is a continuation-in-part of application No. 12/217,613, filed on Jul. 7, 2008, which is a continuation-in-part of application No. 11/805,307, filed on May 23, 2007, now Pat. No. 7,474,216, which is a continuation-in-part of application No. 11/363,436, filed on Feb. 27, 2006, now Pat. No. 7,286,054, which is a continuation-in-part of application No. 11/056,565, filed on Feb. 11, 2005, now Pat. No. 7,382,256, which is a continuation-in-part of application No. 11/008,641, filed on Dec. 9, 2004, now abandoned.

(51) Int. Cl.
*G08B 13/14* (2006.01)

(52) U.S. Cl. ..... 340/572.1; 340/572.3; 340/568.1; 340/572.9; 340/572.8

(58) Field of Classification Search ..... 340/572.1, 340/572.3, 568.1, 572.9, 572.8
See application file for complete search history.

(56) References Cited

U.S. PATENT DOCUMENTS

| | | | |
|---|---|---|---|
| D205,049 | S | 6/1966 | Brady et al. |
| 3,974,581 | A | 8/1976 | Martens et al. |
| 4,299,870 | A | 11/1981 | Humble |
| 4,339,853 | A | 7/1982 | Lipschitz |
| 4,523,356 | A | 6/1985 | Charlot, Jr. |
| 4,527,310 | A | 7/1985 | Vandebult |
| 4,590,461 | A | 5/1986 | Cooper |
| 4,603,453 | A | 8/1986 | Yokoyama |
| 4,651,136 | A | 3/1987 | Anderson et al. |
| 4,670,950 | A | 6/1987 | Wisecup et al. |
| 4,685,234 | A | 8/1987 | Anderson et al. |
| 4,774,503 | A | 9/1988 | Bussard |
| 4,884,833 | A | 12/1989 | Pendersen |
| 4,944,075 | A | 7/1990 | Hogan |

(Continued)

FOREIGN PATENT DOCUMENTS

BE 1 004 849 A7 2/1993

(Continued)

*Primary Examiner* — Hoi Lau
(74) *Attorney, Agent, or Firm* — Malloy & Malloy, P.L.

(57) ABSTRACT

A security tag assembly and security system associated therewith to prevent the unauthorized removal of merchandise from a given area, such as a retail establishment. The security tag assembly comprises a base and at least one tag member removably connected in an operative position on the merchandise being protected. A locking assembly is structured to restrict detachment of the tag member and is forcibly disposed out of a locking orientation relative to said tag member. A detachment assembly and a data registering processor may include a two-way communication link which facilitates processing of the merchandise data disposed on the security tag assembly, such that the purchasing of the merchandise and the removal of the security tag assembly can be effectively accomplished without jeopardizing the security of the merchandise being sold.

20 Claims, 22 Drawing Sheets

U.S. PATENT DOCUMENTS

| | | | | |
|---|---|---|---|---|
| 4,993,245 | A | 2/1991 | Ott | |
| 5,031,287 | A | 7/1991 | Charlot, Jr. et al. | |
| 5,054,172 | A | 10/1991 | Hogan et al. | |
| 5,077,872 | A | 1/1992 | Guthammar | |
| 5,088,165 | A | 2/1992 | Minasy et al. | |
| 5,151,684 | A | 9/1992 | Johnsen | |
| 5,205,024 | A | 4/1993 | Willard | |
| 5,208,580 | A | 5/1993 | Crossfield | |
| D343,134 | S | 1/1994 | Witzky et al. | |
| D343,135 | S | 1/1994 | Witzky et al. | |
| D344,033 | S | 2/1994 | Davidge | |
| 5,347,262 | A | 9/1994 | Thurmond et al. | |
| 5,367,289 | A | 11/1994 | Baro et al. | |
| D354,924 | S | 1/1995 | Garner et al. | |
| 5,426,419 | A * | 6/1995 | Nguyen et al. | 340/572.9 |
| 5,497,639 | A | 3/1996 | Charlot, Jr. | |
| 5,587,703 | A | 12/1996 | Dumont | |
| 5,600,977 | A | 2/1997 | Piron | |
| 5,613,384 | A | 3/1997 | Weber et al. | |
| 5,748,089 | A | 5/1998 | Sizemore | |
| 5,786,762 | A | 7/1998 | Liu | |
| D410,400 | S | 6/1999 | Skjellerup | |
| 5,912,622 | A | 6/1999 | Endo et al. | |
| 5,942,978 | A | 8/1999 | Shafer | |
| 5,942,987 | A | 8/1999 | Heinrich et al. | |
| 5,955,951 | A | 9/1999 | Wischerop et al. | |
| 6,023,951 | A | 2/2000 | Maurer et al. | |
| 6,089,453 | A | 7/2000 | Kayser et al. | |
| 6,281,800 | B1 | 8/2001 | Sizemore | |
| 6,348,865 | B1 | 2/2002 | Siegel | |
| D455,363 | S | 4/2002 | Fuss | |
| 6,535,130 | B2 | 3/2003 | Nguyen et al. | |
| 6,722,166 | B2 | 4/2004 | Skjellerup | |
| 6,724,307 | B1 | 4/2004 | Siegel | |
| 6,752,837 | B2 | 6/2004 | Karp | |
| D494,488 | S | 8/2004 | Sayegh | |
| 6,774,794 | B2 | 8/2004 | Zimmerman et al. | |
| 7,073,236 | B2 | 7/2006 | Xue et al. | |
| 7,075,440 | B2 | 7/2006 | Fabian et al. | |
| 7,148,805 | B2 * | 12/2006 | Hogan | 340/572.9 |
| 7,183,917 | B2 | 2/2007 | Piccoli et al. | |
| 7,286,054 | B2 | 10/2007 | Skjellerup et al. | |
| 7,382,256 | B2 | 6/2008 | Skjellerup et al. | |
| 7,474,216 | B2 | 1/2009 | Skjellerup et al. | |
| 7,523,630 | B2 | 4/2009 | Skjellerup | |
| D603,739 | S | 11/2009 | Skjellerup | |
| 7,750,806 | B1 | 7/2010 | Skjellerup et al. | |
| 7,817,041 | B2 | 10/2010 | Skjellerup et al. | |
| 2002/0105424 | A1 | 8/2002 | Alicot et al. | |
| 2003/0067397 | A1 | 4/2003 | Trimble | |
| 2004/0070507 | A1 | 4/2004 | Campero | |
| 2004/0231375 | A1 | 11/2004 | Skjellerup | |
| 2004/0233042 | A1 | 11/2004 | Piccoli et al. | |
| 2005/0218218 | A1 | 10/2005 | Koster | |
| 2006/0139176 | A1 | 6/2006 | Skjellerup et al. | |

FOREIGN PATENT DOCUMENTS

| | | | |
|---|---|---|---|
| DE | 200 14 860 | U1 | 10/2000 |
| DE | 20 2004 008 789 | U1 | 11/2004 |
| DE | 20 2004 013 895 | U1 | 12/2004 |
| EP | 0 012 923 | A1 | 7/1980 |
| EP | 0 142 748 | A1 | 5/1985 |
| EP | 0 404 329 | A1 | 12/1990 |
| EP | 0 594 324 | A2 | 4/1994 |
| EP | 1 391 574 | A2 | 2/2004 |
| JP | 2005-71143 | A | 3/2005 |
| JP | 2006-249364 | A | 9/2006 |
| WO | WO 2004/106674 | A1 | 12/2004 |
| WO | WO 2005/118991 | A1 | 12/2005 |

* cited by examiner

SECURITY TAG ASSEMBLY

CLAIM OF PRIORITY

The present application is a continuation-in-part application having Ser. No. 12/316,586, filed on Dec. 12, 2008, now U.S. Pat. No. 7,817,041, which matured on Oct. 19, 2010, which is a continuation-in-part application of a previously filed, now pending application having Ser. No. 12/217,613, filed on Jul. 7, 2008, which is a continuation-in-part application of U.S. patent application having Ser. No. 11/805,307, filed on May 23, 2007, now U.S. Pat. No. 7,474,216, which matured on Jan. 6, 2009, which is a continuation-in-part of U.S. patent application having Ser. No. 11/363,436, filed on Feb. 27, 2006, now U.S. Pat. No. 7,286,054, which matured on Oct. 23, 2007, which is a continuation-in-part of U.S. patent application having Ser. No. 11/056,565, filed on Feb. 11, 2005, now U.S. Pat. No. 7,382,256, which matured on Jun. 3, 2008, which is a continuation-in-part application of a previously filed, now abandoned application having Ser. No. 11/008,641, filed on Dec. 9, 2004, now abandoned all of which are incorporated herein in their entirety by reference.

BACKGROUND OF THE INVENTION

1. Field of the Invention

This invention relates to a security system incorporating a security tag assembly comprising a base and an attachment member removably securable to various types of merchandise. The security system further comprises a detachment assembly structured to disconnect the base and attachment member and thereby remove the security tag assembly from the merchandise.

2. Description of the Related Art

Security or anti-theft tags are extensively used in the retail merchandising industry as well as numerous other areas of commerce. In typical fashion, such devices are attached to various types of merchandise in such a manner that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

As set forth above known security or anti-theft tags are intended to provide some indication which either renders the merchandise useless or alternatively signals an attempted unauthorized removal.

While popular, it is recognized that a significant number of the anti-theft tags currently being utilized include problems or disadvantages which render them less than totally efficient. More specifically, wide spread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for a security system incorporating an anti-theft device preferably in the form of a relatively small security tag assembly which efficiently connects to various types of merchandise and which is specifically structured to overcome known techniques to remove or otherwise defeat such devices. Moreover, such protective structural features should be compatible with an efficient tag construction and configuration. Therefore, a security tag manufacture or provider can effectively "customize" a proposed indicator assembly to include various "theft indicating" devices, electronic signaling devices or a combination thereof, while not requiring a restructuring or redesign of the entire tag assembly or the remaining, basic operable components associated therewith.

SUMMARY OF THE INVENTION

Present invention is directed to a security system more specifically comprising at least one security tag assembly. As practically utilized and applied, a plurality of security tag assemblies are utilized to prevent unauthorized removal of various types of merchandise, products, etc. from a given area, such as a store or other location where customers are allowed to examine merchandise prior to purchase. As such, the security tag assembly of the present invention is structured to be connected to a variety of different types of products, merchandise, etc. such as, but not limited to, garments and the like. In addition, attachment of the security tag assembly can be accomplished by authorized procedures and/or personnel utilizing cooperatively structured detachment equipment. Further, while a large number of the security tag assemblies of the present invention may be utilized in anyone or a plurality of locations, a description of the operative and structural features of a single attachment assembly will be described herein and be representative of larger number of security tag assemblies that may be utilized and accordingly, which may define a security or anti-theft system.

More specifically, one or more preferred embodiments of the security tag assembly of the present invention comprises a base having an at least partially hollow interior of sufficient dimension and configuration to contain a locking assembly therein. As such, the various components associated with the locking assembly serve to normally bias it into a "locking orientation". In cooperation therewith, at least one preferred embodiment of the security tag assembly includes an attachment member preferably in the form of an elongated attachment pin structured to be connected to the product being monitored, such as by penetrating such a product and then be disposed in a locking position relative to the base. A preferred locking position comprises the attachment pin passing into the interior of the base and into removable locking engagement with the locking assembly, when the locking assembly is in the locking orientation.

A release member is movably disposed within the base in confronting, and/or force transferring relation to at least a portion of the locking assembly. As such the release member may be disposed into displacing engagement with the locking assembly, thereby forcing it out of a locking orientation relative to the attachment pin. In addition, the release member is structured to be gripped by or define a gripping engagement with an authorized externally applied detachment assembly. Such an authorized detachment assembly is specifically structured to operatively remove the tag member from the base when an authorized removal of the product or merchandise to which the security tag assembly is attached is warranted.

Structural and operative features of the authorized detachment assembly may vary but its cooperative structuring with the base and the release member call for the detachment assembly to include a plurality of detachment members. As a result, interaction between the plurality of detachment members and the release member results in the aforementioned gripping engagement of at least some of the plurality of detachment members when the detachment members are externally applied to the base. Such external application is accomplished by passing the detachment members at least partially through the base into the interior thereof and in confronting engagement with the release member.

Accordingly, interaction of the plurality of detachment members with the base and in particular the release member establishes the aforementioned gripping engagement. Moreover, the movable disposition of the release member within the base and its confronting, displacing engagement and/or driving relation with the locking assembly will serve to force the locking assembly out of the aforementioned locking orientation relative to the attachment pin. Removal of the locking assembly out of the locking orientation relative to the attachment pin is more specifically accomplished by an outwardly directed, pulling force being exerted on the release member by the plurality of detachment members.

More specifically, various operative and structural details of the aforementioned detachment assembly is such as to facilitate the initial application of the plurality of detachment members through the base and into the aforementioned gripping engagement with the release member. Subsequent to establishment of the gripping engagement with the release member, the detachment assembly is operative to pull or otherwise force the plurality of detachment members outwardly from the base. As a result, an outwardly directed, pulling force will be exerted on the release member concurrent to the attempted outwardly directed movement of the plurality of the detachment members. The established gripping engagement between the plurality of detachment members and the release member will be sufficient to force movement of the release member into driving, displacing engagement with the locking assembly. In turn, the locking assembly will be forced outwardly or away from the attachment pin and from its locking orientation relative thereto, thereby allowing the tag assembly affixed to the attachment pin to be removed from the base in an authorized manner. As set forth above the product or merchandise to which the security tag assembly is connected can thereby be removed from the monitored area, such as when being purchased.

At least one preferred embodiment of the security tag assembly of the present invention includes an alignment assembly disposed on the base in an externally accessible location. The alignment assembly is structured to facilitate alignment between the base and the plurality of detachment members associated with the detachment assembly. As set forth above the attachment assembly may assume a variety of different structural configurations but include the aforementioned plurality of detachment members disposed and structured to pass into the base and in gripping engagement with the release member. In order to facilitate proper and intended interaction between the plurality of detachment members and the release member, the base includes a plurality of access openings disposed in aligned relation with a plurality of receiving channels formed in at least one embodiment of the release member. At least some of the plurality of access openings and at least some of the plurality of release channels are disposed in substantially aligned relation to one another at least to the extent that at least some of the plurality of detachment members pass through the access opening and into gripping engagement with release member by virtue of their interaction with the plurality of receiving channels.

In order to facilitate the above described interaction between the plurality of detachment members and the release member, to define the gripping engagement therebetween, the alignment assembly is disposed, structured and configured to properly align the base and more specifically at least some of the plurality of access openings with the detachment members associated with the detachment assembly. As such, the disposition and configuration of the alignment assembly is such as to accomplish the predetermined and preferred alignment. Such a predetermined structural configuration of the alignment assembly may include, but is not limited to, a multi-sided peripheral configuration such as being in the form of a multi-sided figure including, but not limited to, a square, rectangular, triangle pentagon, star-shape, or other multi-sided peripheral configuration. At least a portion of the detachment assembly is cooperatively structured with the alignment assembly to receive it and facilitate and easy and quick orientation of the base such that alignment between the detachment members and the access openings/receiving channels is accomplished.

Additional structural and operative features of at least one preferred embodiment of the present invention includes the provision of a coil or other appropriate structure which includes alarm activating capabilities and/or radio frequency signaling capabilities. As such, the coil or other structure is mounted within the base, in preferably a non-accessible location. Depending on the embodiment utilized, the coil or other RF signaling structure may also have data storage capabilities. Therefore, the provided RF signaling structure may be utilized to automatically provide inventory, purchase, location, origin of supplier or manufacturer and other merchandise data, by wireless communication with appropriate receiving facilities associated with a cash register or other check out facilities. The RF signaling structure may also be capable of activating alarm facilities, such as those located at the entrance, etc. of the store where the products are sold.

Therefore, the various preferred embodiments of the security tag assembly of the present invention overcomes many of the problems and disadvantages associated with conventional or previously known security systems. Further, the various preferred embodiments of the security tag assembly comprise simple, efficient practical structures which facilitate, the attachment, removal and efficient practicing of security procedures so as to prevent or at least significantly restrict the unauthorized removal of protected merchandise or products from a given area.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
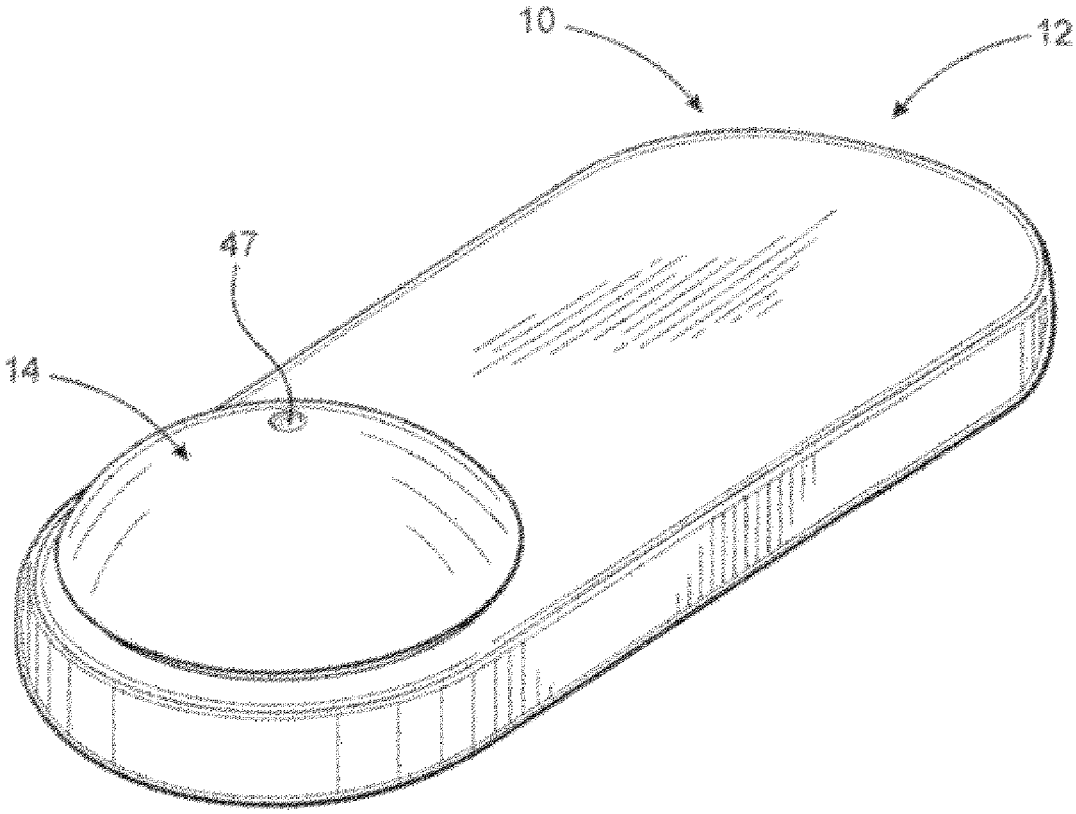
FIG. 1 perspective view of one preferred embodiment of the security tag assembly of the present invention.
Figure 3:
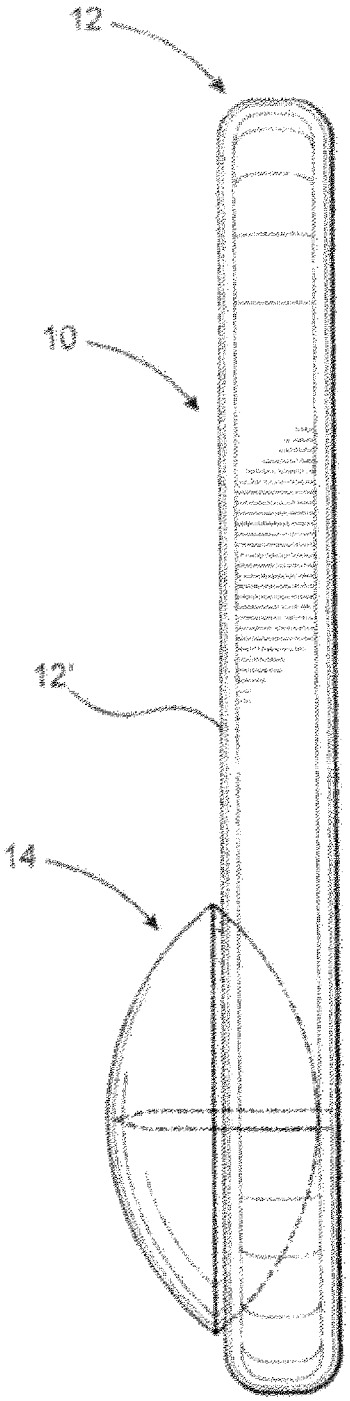
FIG. 3 is a left side view of the embodiment of FIG. 2.
Figure 2:
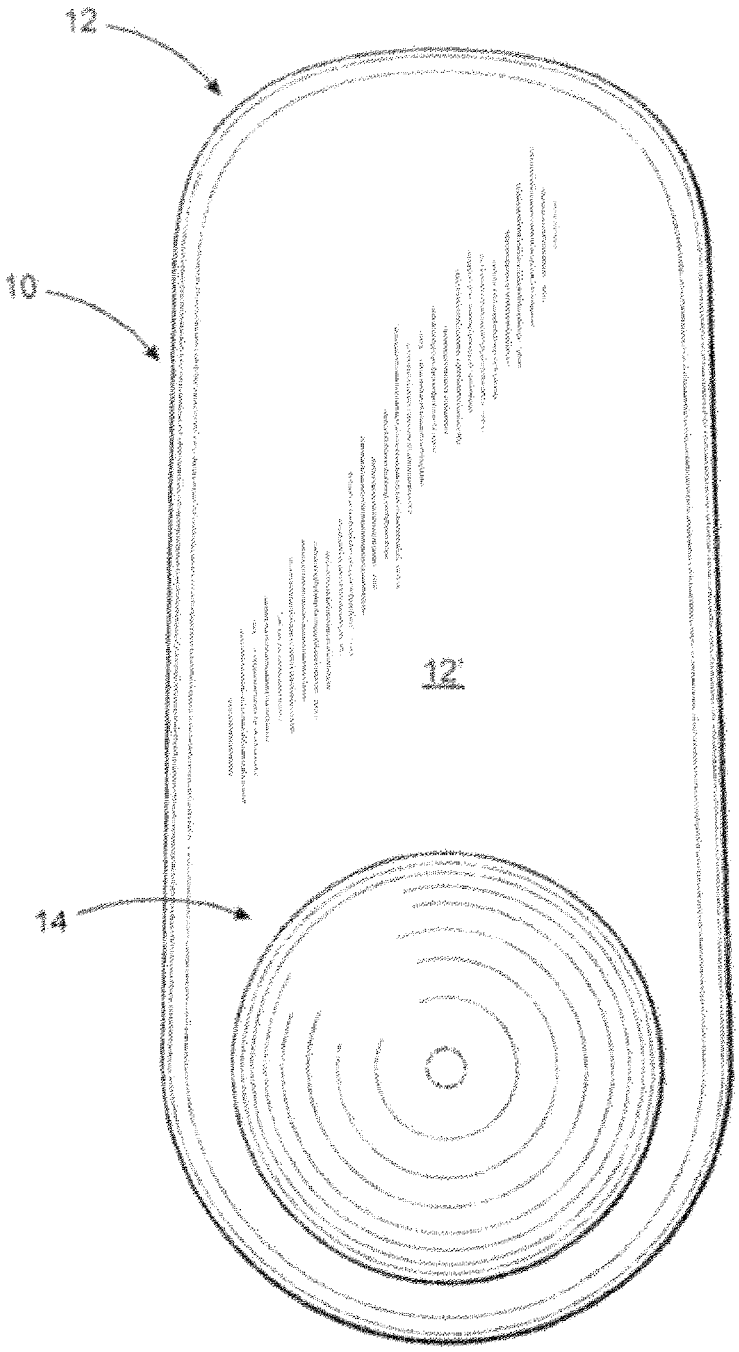
FIG. 2 is a top view of the embodiment of FIG. 1.
Figure 4:
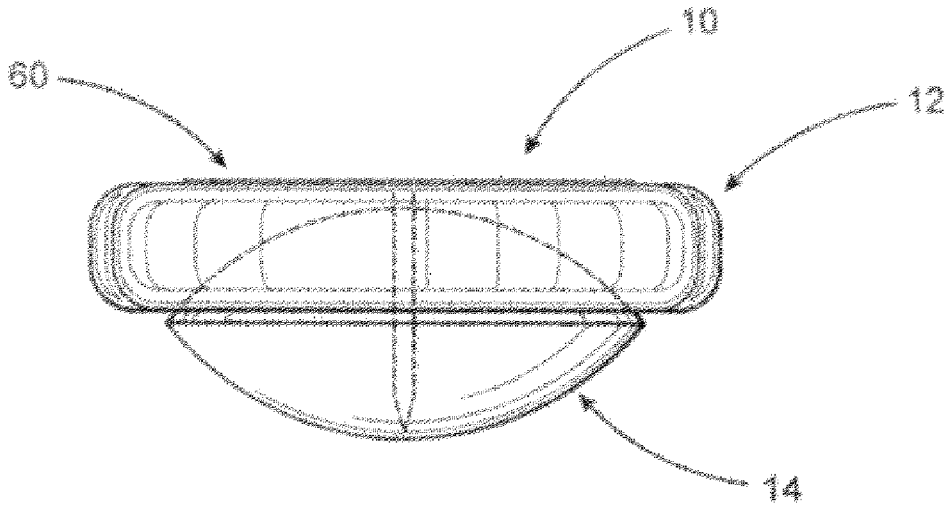
FIG. 4 is a bottom view of the embodiment of FIG. 2.
Figure 6:
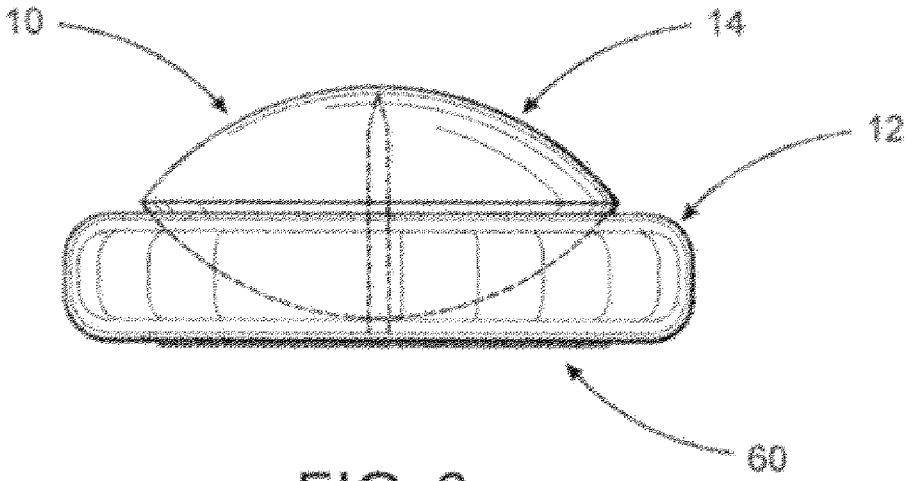
FIG. 6 is a top view of the embodiment of FIG. 2.

As shown in the accompanying drawings, the present invention is directed towards a security tag assembly generally indicated as 10 and comprising at least one base 12 and at least one attachment member 14. However, a practical application of the present invention would typically involve a plurality of bases 12 and a plurality of attachment members 14, such as when a plurality of different products were being protected and/or monitored. Moreover, the security tag assembly 10 is of the type structured to be removably secured to various types of merchandise 18 so as to prevent unauthorized removal of the merchandise 18 from a given area or location. Typical applications for the security tag assembly 10 of the present invention include the interconnecting of one base 12 and any one of a plurality of attachment members 14 to merchandise 18 being protected. As such, removal of the security tag assembly 10 from its operative position can be quickly and easily accomplished by authorized personnel utilizing approved techniques and/or hardware. To the contrary, separation of the base 12 and the attachment member 14 from the operative position and the protected merchandise is extremely difficult when attempted by unauthorized personnel.

Further, at least one preferred embodiment of the present invention comprises each of the plurality of attachment members 14 being structured to be disposable after use, subsequent to being removed from a corresponding base 12 and the merchandise being protected. In contrast, the one or more bases 12 of the security tag assembly 10 of the present invention include various structural and operative features which enable their repeated use. Such features include, but are not limited to, an indicator assembly and a connector member which allow any one of the bases 12 to be connected to any one of the "unused" attachment members 14, as will be described in greater detail hereinafter.

More specific structural details of the various preferred embodiments of the present invention include the base 12 having a generally elongated or other appropriate configuration. In addition, maintenance of the merchandise 18 in a clamped orientation between the base 12 and the attachment member 14 is further facilitated by a seat 20 disposed on the base. The seat 20 is preferably configured to correspond to the outer surface configuration 14' of the attachment member which is disposed in a substantially seated or aligned received relation within the seat 20. The structures of the preferred embodiments represented in the various figures include the seat 20 having a substantially concave configuration which corresponds to the substantially convex configuration 14' of the attachment member 14. Accordingly, when the base 12 and attachment member 14 are in the aforementioned and preferred operative position, the merchandise 18, depending upon its physical characteristics may be effectively clamped "within" the seat 20 between the base 12 and the outer surface portion 14' of the attachment member 14.

In order to maintain a secure interconnection between the base 12 and the one or more attachment members 14, the base 12 is provided with a connector member generally indicated as 22 comprising an elongated connector pin or like structure 24. The innermost end 26 of the pin is secured to the base 12 preferably, but not necessarily, in cooperation with the seat 20. Moreover, the length of the connector pin 24 is sufficient to extend outwardly from the seat 20 as well as a remainder of the adjacent exterior surface 12' of the base 12 so as to engage and be properly connected to the attachment member 14.

Figure 9A:
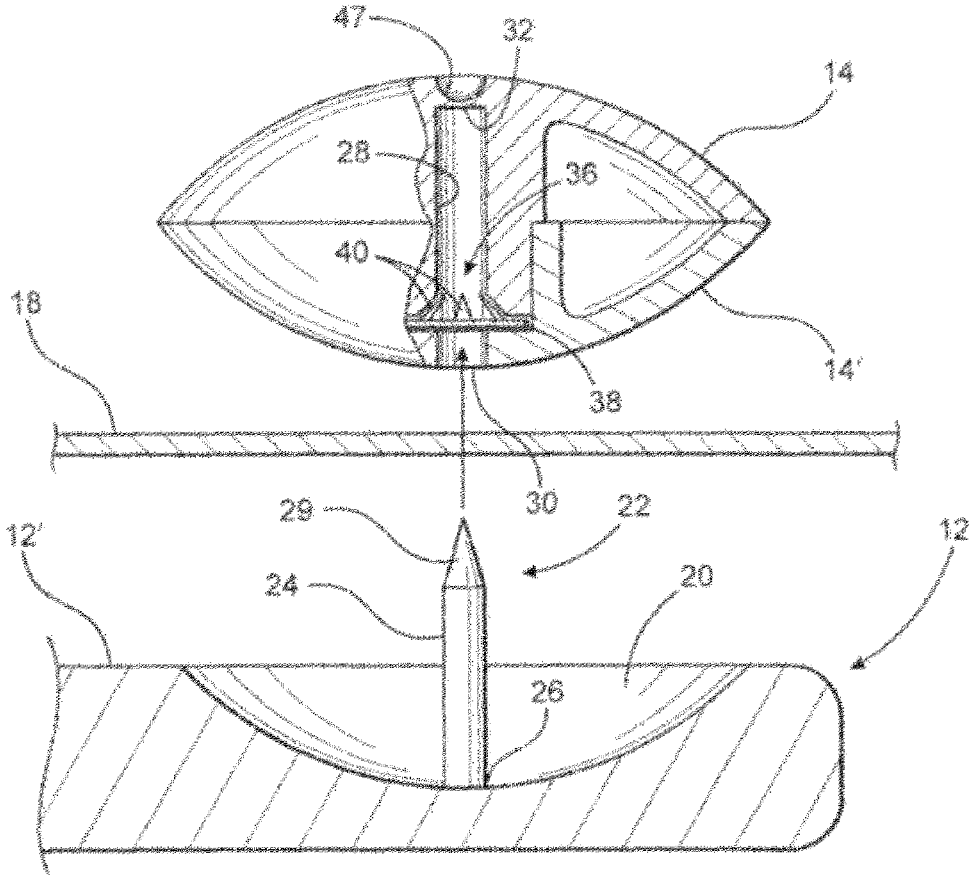
FIG. 9A is an exploded view in partial cutaway and section showing the relative positions of the various operative components for the embodiments of FIGS. 1 through 8 in an unassembled orientation.
Figure 9B:
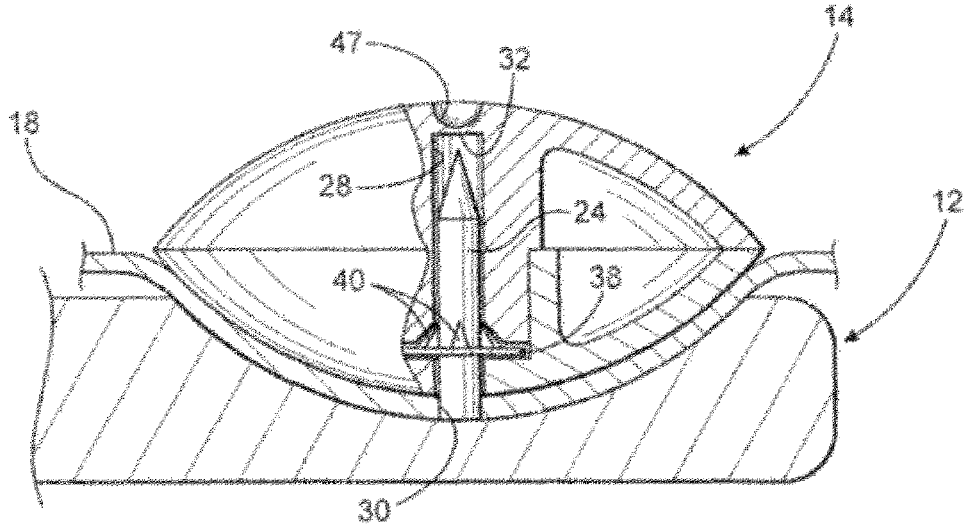
FIG. 9B is a sectional view in partial cutaway of the embodiment of FIG. 9A in an assembled orientation.
Figure 9C:
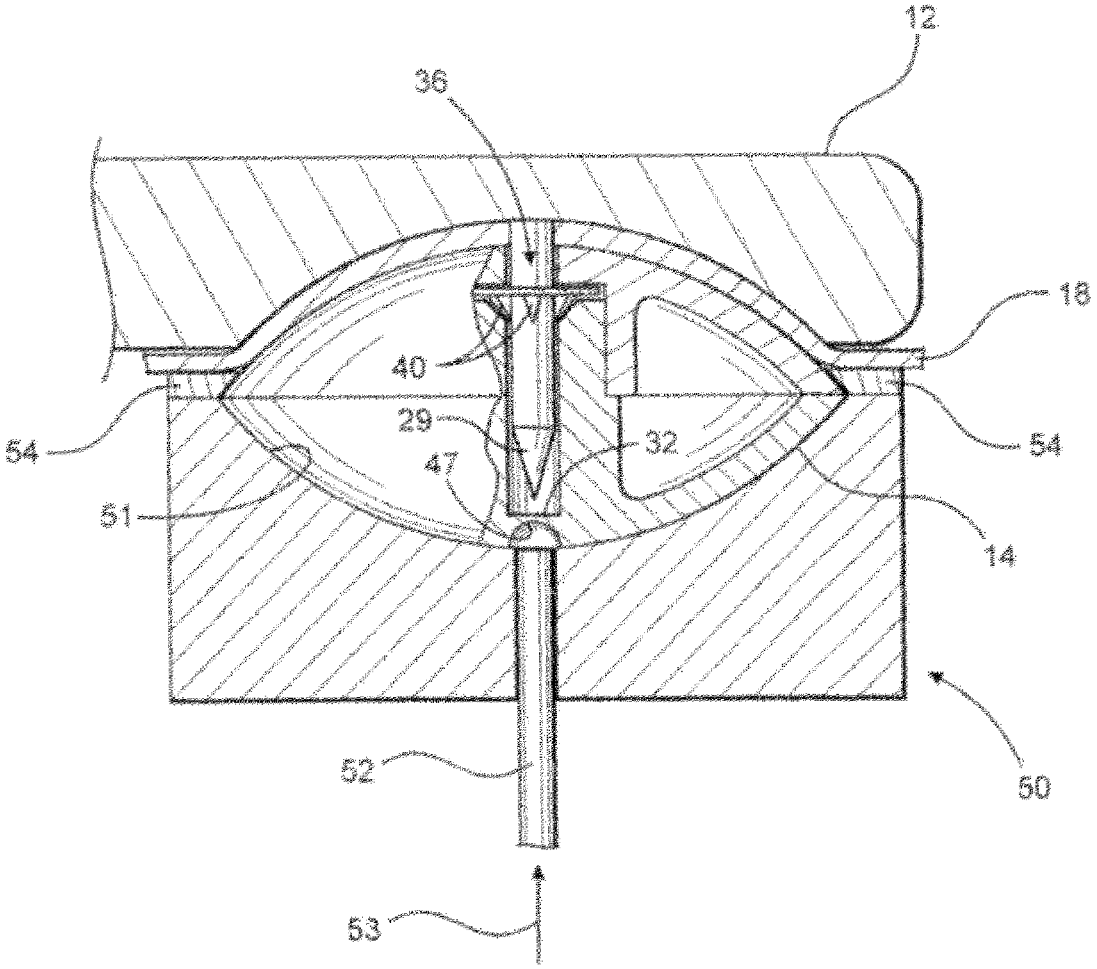
FIG. 9C is a sectional view in partial cutaway representing the separation of the operative components of the preferred embodiment of the present invention from that shown in FIG. 9B.

Cooperative structuring of each of the plurality of attachment members 14 includes an elongated passage or channel 28 disposed on the interior of the one or more attachment members 14. Moreover, the channel 28 has a proximal end 30, which is preferably open, as well as a distal end 32. Each of the proximal and distal ends, 30 and 32 respectively, are disposed contiguous with or immediately adjacent to opposed exterior surface portions of the one or more attachment members 14 as clearly demonstrated in FIGS. 9A through 9C. Therefore, the channel 28 extends substantially entirely along a transverse dimension of the attachment member, wherein such transverse dimension is at least partially defined by the location of the oppositely disposed proximal and distal ends 30 and 32, respectively, of the channel 28. The securing of the attachment member 14 in the preferred, operative position comprises penetration of the merchandise 18 by the connector pin 24 and continued travel of the connector pin 24 through the open proximal end 30 and into the interior of the channel 28 and along a substantial portion of the length thereof. Penetration of the merchandise 18 by the connector pin 24 as well as its passage into the channel 28 may further be facilitated by a pointed or other appropriately shaped tip 29, as demonstrated.

Additional structural features of the various preferred embodiments of the present invention include the provision of a locking assembly generally indicated as 36. The locking assembly 36 is disposed on or preferably within the interior of the attachment member 14 and/or at least in communication with the channel 28 and open end 30 so as to be disposed in receiving relation to the connector pin 24. Therefore, as the connector pin 24 is disposed within the channel 28, it will pass through the open proximal end 30 and be received by the locking assembly 36 as the pin 24 passes there through. One preferred embodiment of the locking assembly 36 comprises a ring 38 disposable in surrounding, concentric relation to the connector pin 24 when it is positioned within the interior of the channel 28 as clearly demonstrated in FIGS. 9B and 9C. In addition, the locking assembly 36 includes a plurality of spaced apart fingers 40 normally disposed in an outwardly angular orientation. As such outer portions of the plurality of fingers 40 movably engage the connector pin 24 when it is disposed within the channel 28. Further, the structure, configuration, disposition and outwardly angular orientation of each of the plurality of fingers 40 is such as to allow inward travel of the connector pin 20 as it passes into the interior of the attachment member 14 along the channel 28. However, the structure of the plurality of fingers 40 is such as to restrict movement of the connector member 24 in the opposite direction or out of the channel 28, such as when the separation of the attachment member 14 and the base 12 is attempted. The locking assembly 36 can therefore be further described as being disposed and structured to movably engage the connector pin 24 such that it facilitates movement or passage thereof inwardly into the interior of the attachment member 14 along the channel 28. In contrast, the structure and orientation of the plurality of fingers 40 are such as to restrict movement of the connector pin 24 in the opposite direction, out of the channel 28, such as when an attempt to disconnect the base 12 and the attachment member 14 from the intended operative position occurs.

Figure 15:
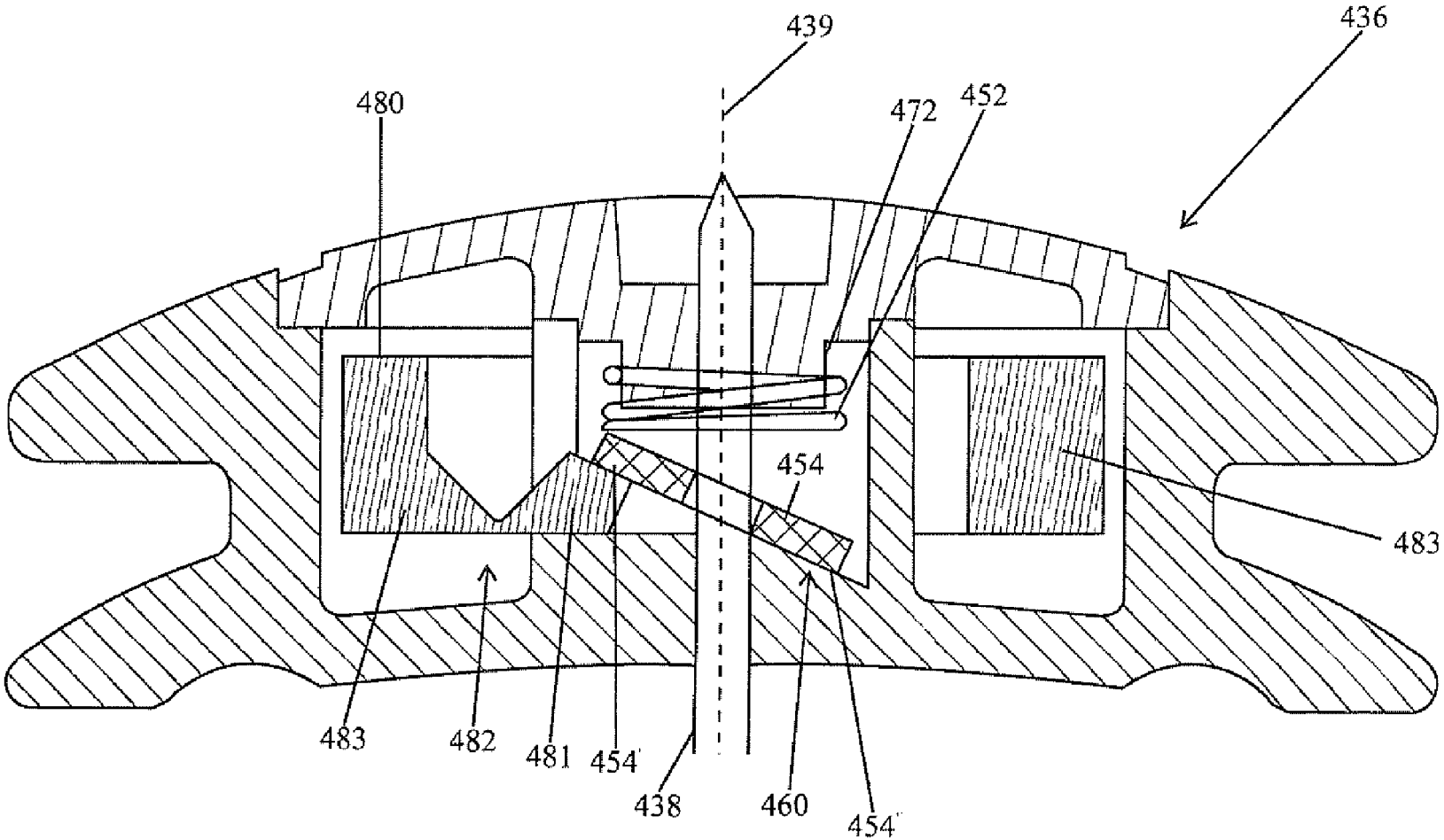
FIG. 15 is a sectional view of yet another embodiment of the attachment assembly of the present invention.
Figure 16:
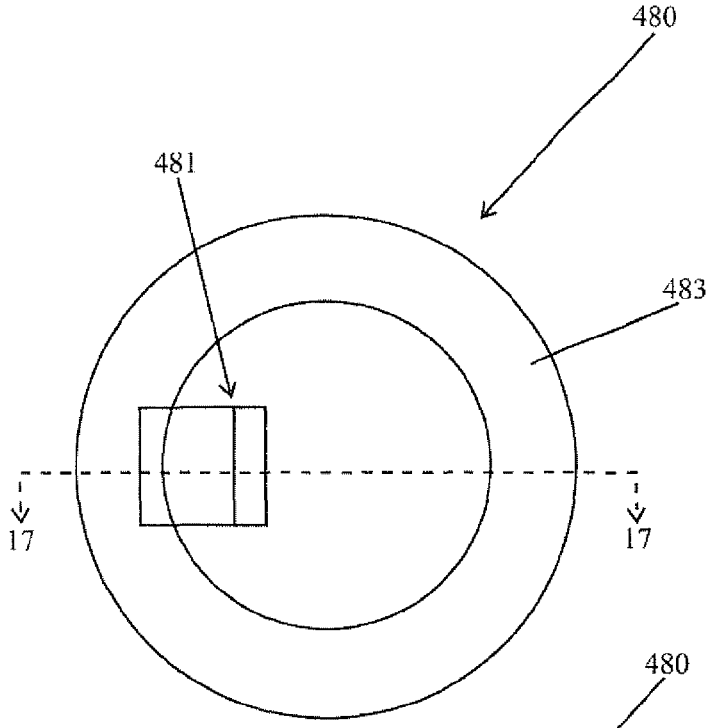
FIG. 16 is a top view of a stabilizer disclosed in accordance with at least one embodiment of the present invention.
Figure 17:
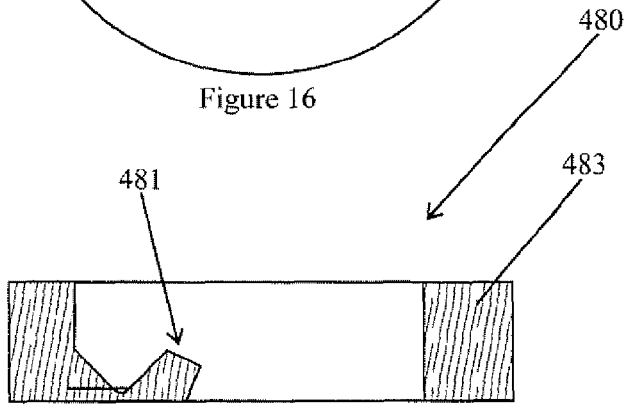
FIG. 17 is a sectional view along line 17-17 of the stabilizer illustrated in FIG. 16.

As set forth above, one operative feature of the various preferred embodiments of the present invention includes the ability to easily and quickly remove the security tag assembly 10 from the merchandise 18 utilizing authorized personnel, techniques and/or hardware. To the contrary, unauthorized separation of the base 12 and the associated attachment member 14 is rendered extremely difficult when the proper procedures and/or hardware are not utilized. With primary reference to FIGS. 9*c*, 9D and 10, separation of the base 12 and the attachment member 14 from their intended operative position in clamping engagement with the merchandise 18 can be easily accomplished utilizing an approved or authorized detachment assembly, generally indicated as 50. The detachment assembly 50 is intended to be only representative of a variety of different devices and/or hardware which could be applied to the security tag assembly 10 and structured to separate the base 12 from the attachment member 14 and detach the merchandise 18 there from without causing damage to the base 12 or merchandise 18. Another preferred embodiment of the detachment assembly 50' is schematically represented in FIGS. 15 and 16, and will be discussed in greater detail hereinafter. Therefore, the detachment assembly 50, as represented in FIG. 10 is not to be considered in a limiting sense since a variety of other structures can be utilized to accomplish authorized separation of the various preferred embodiments of the security tag assembly 10 out of the operative position of FIG. 9B.

Figure 9D:
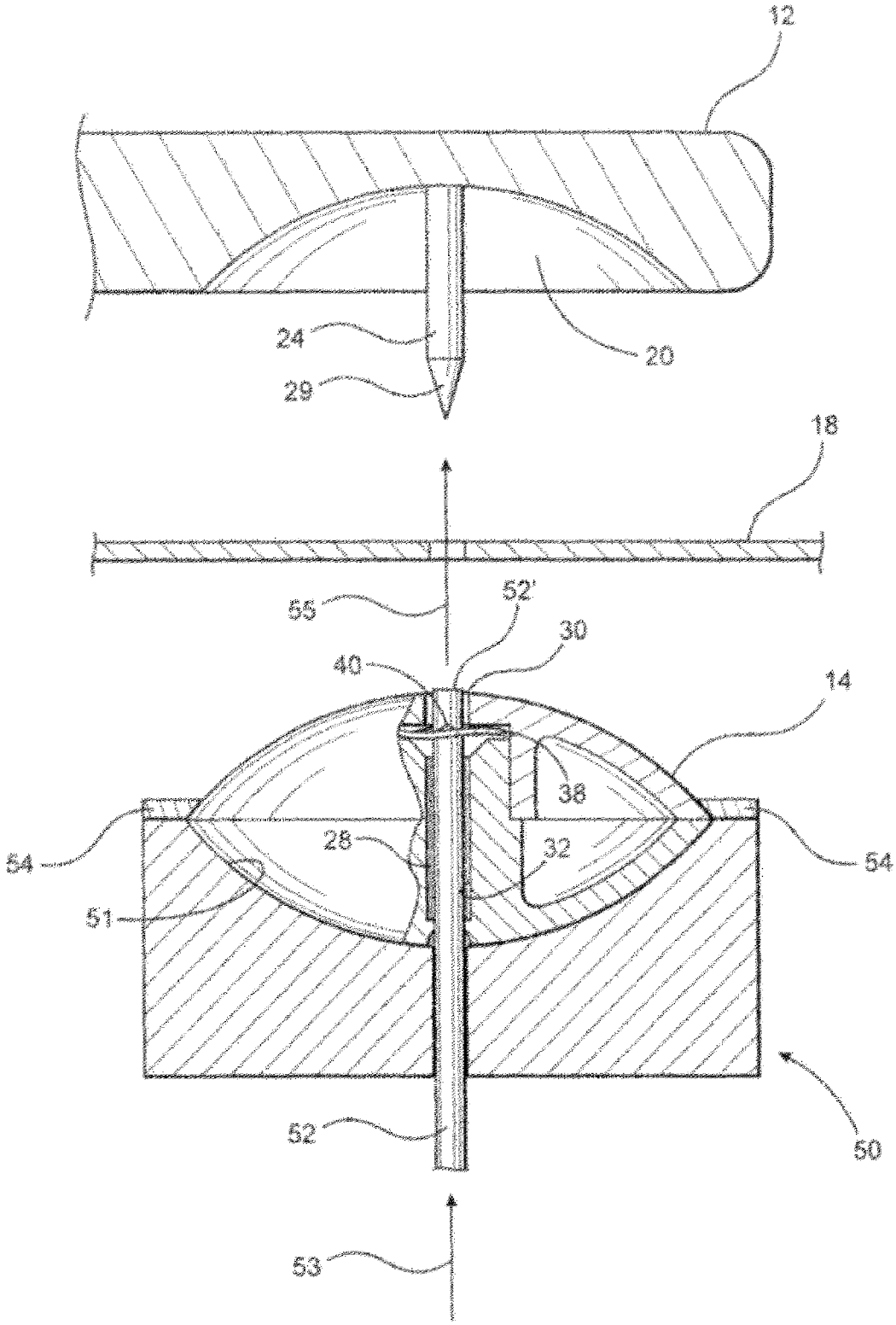
FIG. 9D is an exploded view in cross section and partial cutaway further representing the authorized operation of separating the various components from the position shown in the embodiment of FIG. 9B.
Figure 10:
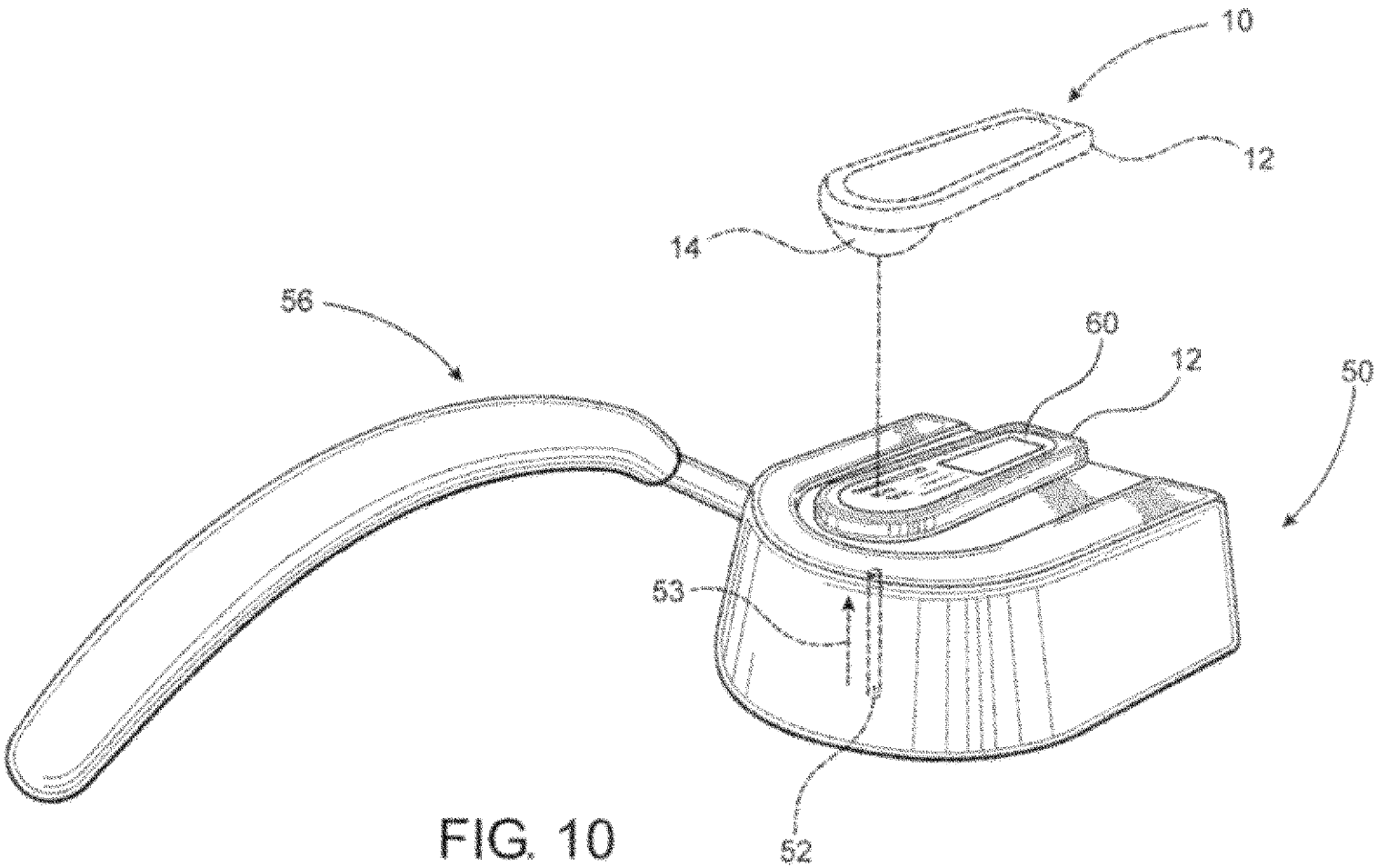
FIG. 10 is a perspective view in exploded form representing a detachment assembly for separating the operative components of the preferred embodiment of the present invention in accord with FIGS. 9C and 9D.

Accordingly, the detachment assembly 50 includes a cavity or like structure 51 (see FIGS. 9C and 9D) for receipt of an attachment member 14 therein when the tag assembly 10 is mounted on the detachment assembly 50 in the orientation disclosed in FIG. 10. In addition, the detachment assembly 50 comprises a drive shaft 52 and a holding or stabilizing structure 54. As also represented, an actuating handle or like structure generally indicated as 56 is connected by appropriate mechanical linkage to the drive shaft 52. A manipulation of the handle assembly 56 causes a positioning of the stabilizing structure 54 into engagement with corresponding portions of the attachment member 14 and a forced movement of the drive shaft 52 into the interior of the attachment member 14, in accordance with directional arrow 53.

The force of the drive shaft 52 will cause a rupture, displacement, detachment and/or otherwise destructive removal of a cover member or portion 47 which overlies and therefore covers or closes the distal end 32 of the channel 28. The specific structuring of the cover member 47 may vary such as being attached in its intended, overlying position to the channel 28 by a weakened or serrated connecting portion. Alternatively, the material from which the attachment member 14, as well as the cover portion 47 is formed may be such as to yield under the linearly directed force exerted thereon by the drive shaft 52 as it travels into the attachment member 14.

Continued travel of the drive shaft 52 into the interior of the channel 28, through the distal end 32, results in an engagement between the extremity 52' of the drive shaft 52 and outer end portion 29 of the connector pin 24. As such, the continued travel and driving force of the drive shaft 52 will force the connector pin 24 out of the channel 28 and against the movement resisting engagement of the locking assembly 36 and the plurality of fingers 40. Also, disposition and structure of the locking assembly 36 including, but not limited to, the structure of the plurality of fingers 40 will cause a destruction, or at least partial deformation, of the locking assembly, as represented in FIG. 9D, as the connector pin 24 is forced outwardly from the channel 28 through the open end 30. Accordingly, the locking assembly 36 can be said to be "destructively detached" and/or displaced from a position relative to and engagement with the connector pin 24 as the pin 24 is forced outwardly from the channel 28 in the opposing direction to its direction of entry, as schematically indicated by directional arrow 55.

Once the base 12 and the attachment member 14 are separated from their intended operative position, connector pin 24 may also be easily removed from the merchandise 18. Therefore, the deformation or at least partial destruction of the locking assembly 36 will most probably render the associated attachment member 14 incapable of further use. Accordingly, the attachment member 14, once forcibly detached from the connector pin 24, such as in the manner described above, may be considered disposable. In contrast the base 12, as indicated above, can be repeatedly used by having others of a plurality of attachment members 14 independently connected thereto in the aforementioned and preferred operative position.

Figure 7:
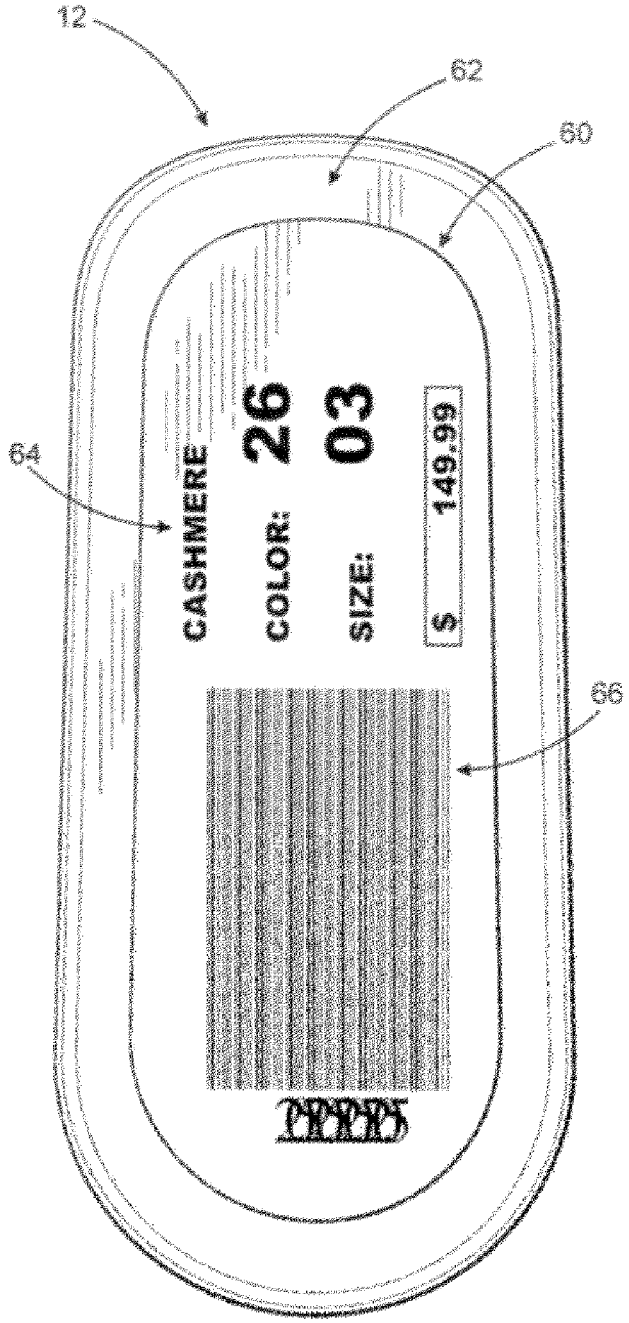
FIG. 7 is a rear view of the embodiment of FIG. 2.
Figure 5:
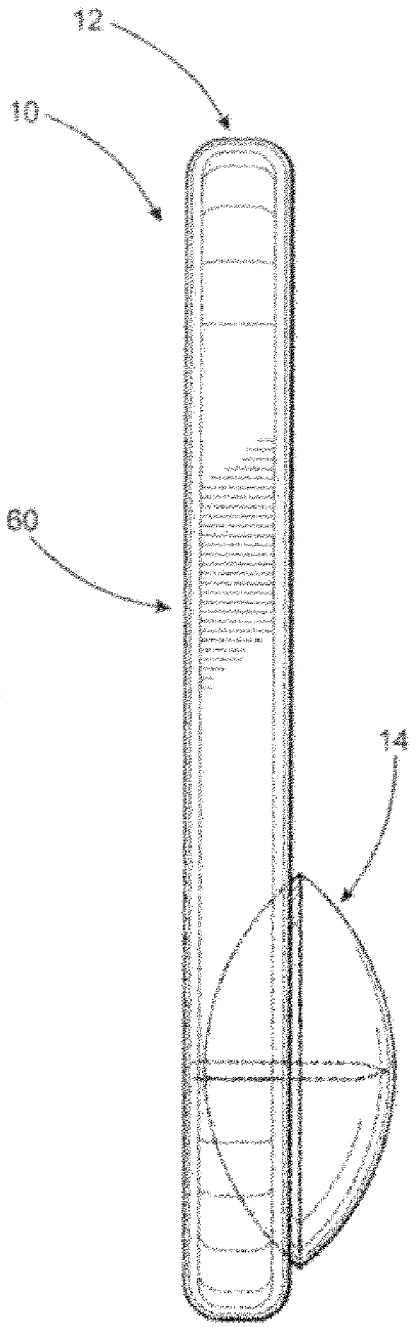
FIG. 5 is a right side view of the embodiment of FIG. 2.
Figure 8:
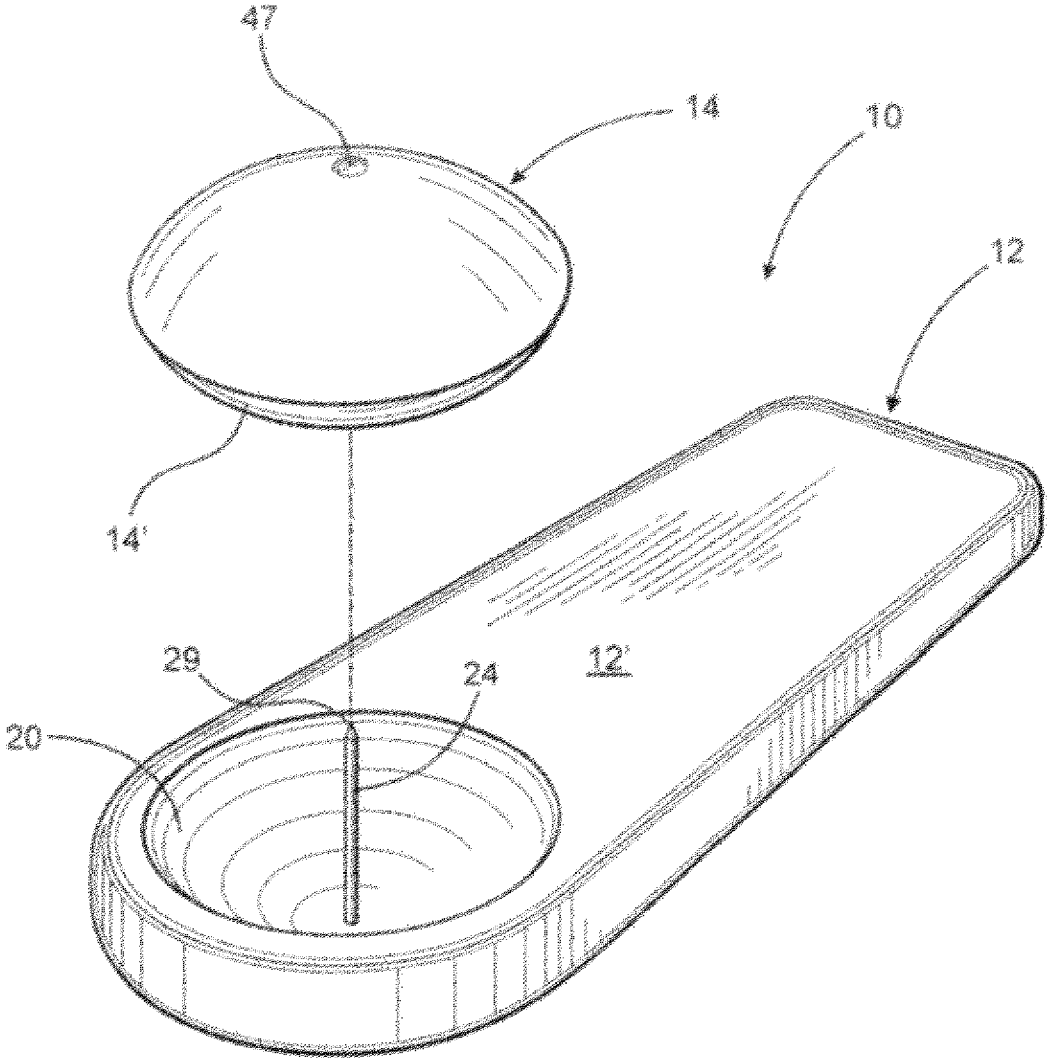
FIG. 8 is a perspective view in exploded form showing a separation of the various operative components of the embodiments of FIGS. 1 through 7.

With primary reference to FIG. 7, yet another structural feature incorporated in at least one preferred embodiment of the present invention is the provision of a display field generally indicated as 60. The display field 60 is formed on any one of a plurality of different exterior surface portions of the base 12 such as on a rear or undersurface 62. The size and configuration of the display field 60 may vary and is at least partially dependent on the size, dimension and configuration of the base 12 as well as the intended informative data or information, generally indicated as 64, intended to appear thereon. The informative data 64 may include different information sections including a bar code, optical or other electrically scanned indicia 66 and/or one or more plurality of printed data sections. The content of the predetermined information and/or data provided for viewing and external exposure would include merchandise information and/or other information regarding the origin, manufacture, distribution history, etc., associated with the merchandise 18 being protected. Other informative data may include physical characteristics of the merchandise or product 18 including size, color, material as well as the pricing thereof. The predetermined data or information, including such information identified as merchandise data is intended to be only representative of a variety of different information and/or data segments or portions which may appear in the display field 60.

Further, the predetermined data or information may be permanently, fixedly and/or removably secured within the display field 60 such as by a labeling and/or by an otherwise fixed and/or secured structuring extending over at least a portion of a corresponding surface 62. Also, the inclusion of the display field 60 can result in time and cost saving features, such as by connecting the security tag assembly 10 at the manufacturing site and thereby "identifying" the merchandise at this point in the product distribution system. By way of example, many products with which the security tag assembly 10 may be used are manufactured in locales having labor costs which are significantly lower than in the geographical location where the products are sold. Therefore, attachment of the security tag assembly 10, having the display field 60 and pertinent data 64 appearing thereon, at the manufacturing site, rather than at the retail outlet, could result in significant savings in labor costs, while assuring that the product is properly marked, described, identified, etc.

Figure 11:
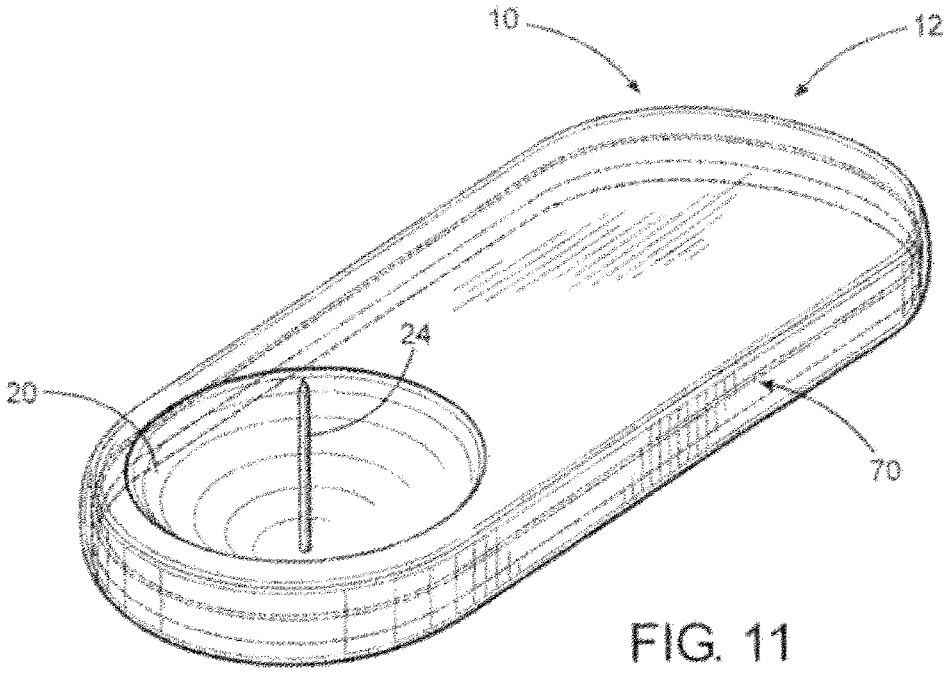
FIG. 11 is a perspective view of yet another preferred embodiment of the present invention incorporating an indicator assembly.
Figure 12:
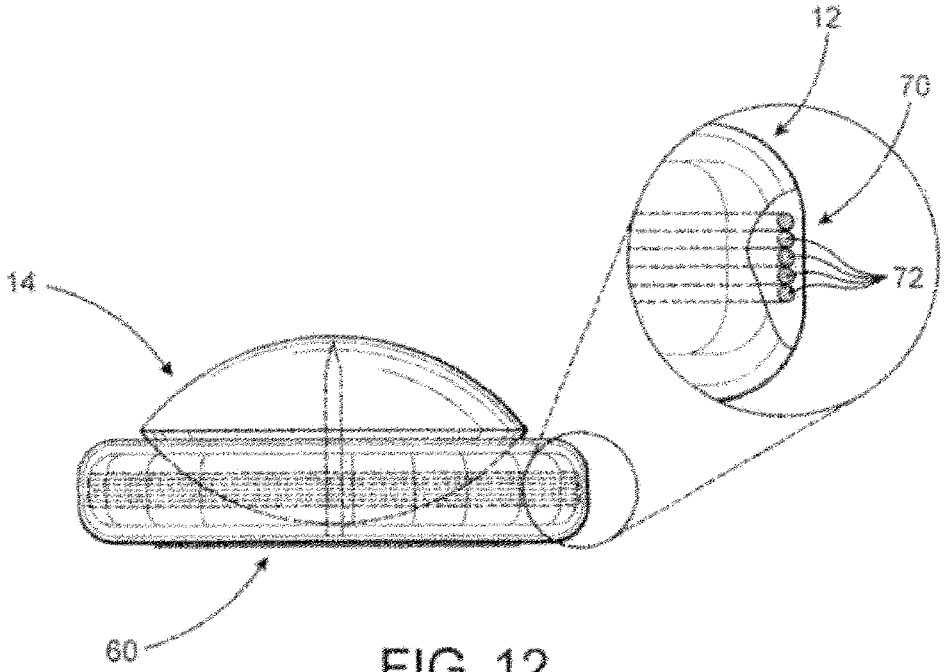
FIG. 12 is a front view and an exploded detail view showing structural details of the embodiment of FIG. 11.

With primary reference to FIGS. 11 and 12, at least one preferred embodiment of the security tag assembly 10 of the present invention comprises an indicator assembly generally indicated as 70. The indicator assembly 70 is mounted and/or connected to the base 12 on at least a portion of the interior thereof as shown in detail in FIG. 12. In a most preferred embodiment of the indicator assembly 70 is formed from a plurality of conductive material coil segments or strands 72. The coil strands 72 may have an at least partially continuous configuration as they are collectively arranged and extend along at least a portion of the periphery of the base 12. As such, the indicator assembly 70 is capable of activating an alarm such as, but not limited to, a proximity alarm of the type typically found and/or associated with entrances and exits of retail establishments. In addition, the indicator assembly 70 comprising the multi-stand construction 72 is structured, configured and disposed to define a radio frequency (RF) coil capable of facilitating RF communication and/or signaling. As such, the RF coil may be modified to demonstrate "tracking" capabilities for the merchandise 18 to which it is attached.

Figure 13:
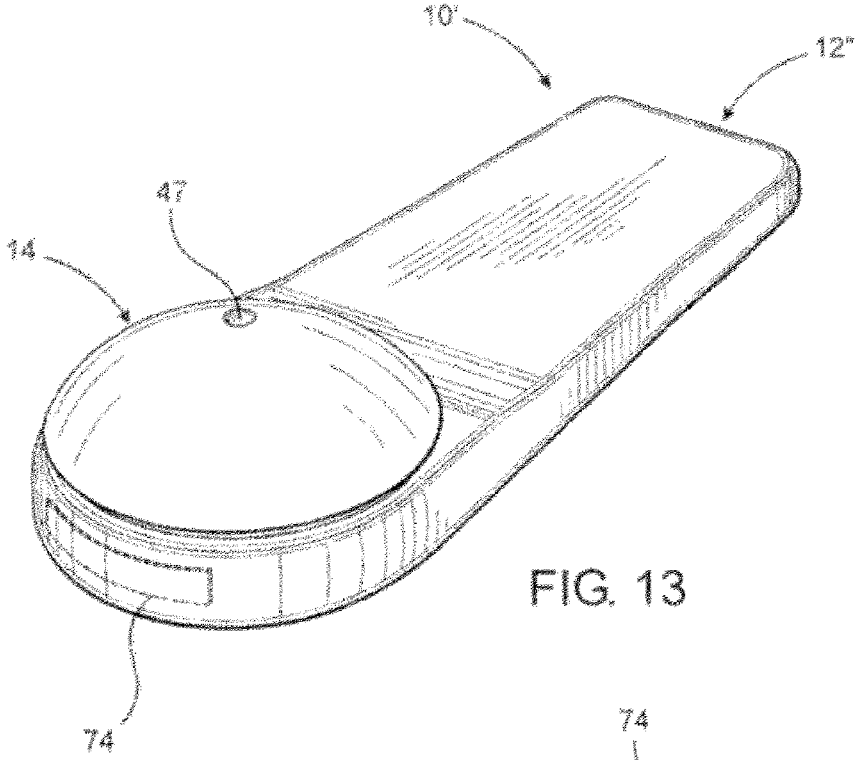
FIG. 13 is a perspective view of yet another preferred embodiment of the present invention shown representing an operative and structural modification from the embodiment of FIGS. 11 and 12.
Figure 14:
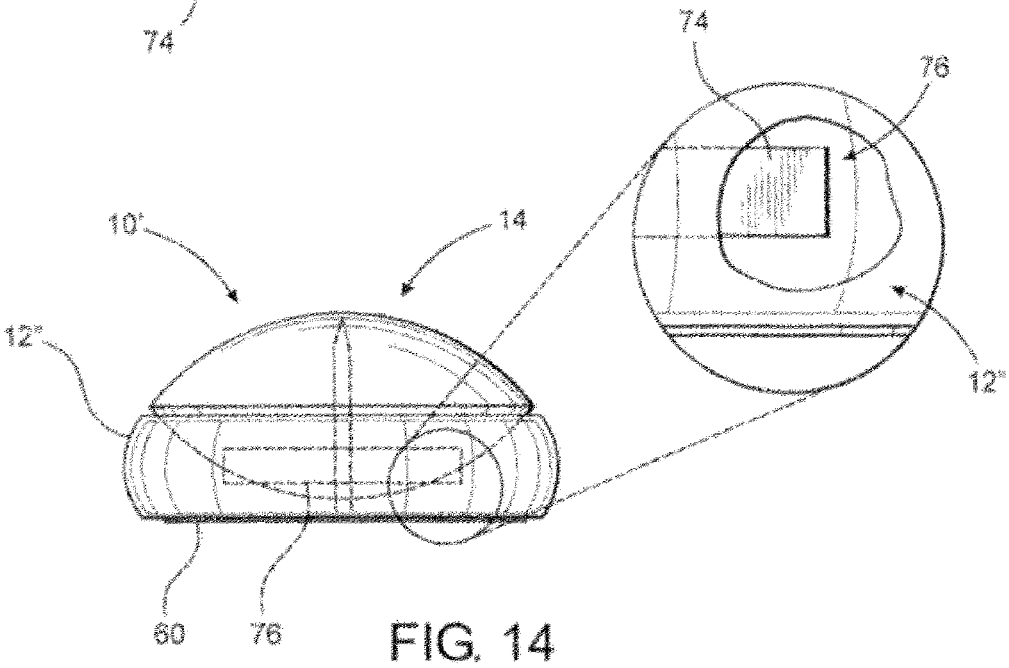
FIG. 14 is a front view and exploded detail view showing structural and operative details of the embodiment of FIG. 13.

Yet another preferred embodiment of the present invention is represented in FIGS. 13 and 14. More specifically, the security tag assembly 10' comprises a base 12" and is structured, similar to the embodiments of FIGS. 1 through 12, to be connected to and used in combination with any one of a plurality of replaceable and disposable attachment members 14. Moreover, various components of the base 12" and the one or more attachment members 14 are equivalently structured to operate in the same manner as described above with specific reference to FIGS. 1 through 12. However, the security tag assembly 10' is distinguishable from the above-noted embodiments through the provision of a base 12" having a varied or modified configuration from that of base 12. More specifically, the base 12" may be somewhat thinner and/or tapered as clearly represented. This alteration in the overall configuration of the base 12" may be at least partially due to the provision of an indicator assembly 74 mounted on and/or connected to the base 12" preferably on the interior thereof in a somewhat hidden location. As such, the indicator assembly 74 includes a conductive or other appropriate material indicator member 76 which is specifically structured, disposed, configured, etc. relative to the structural features of the base 12" to activate an alarm such as, but not limited to, a proximity type of alarm commonly associated with exits and entrances of retail establishments.

In comparing the different preferred embodiments of FIGS. 11, 12 and 13, 14 it is emphasized that the specific structural features in terms of dimensions and configurations may vary from those represented. However, the overall structure of the base 12 and/or 12" should be readily adaptable to the mounting or connection thereto of an indicator assembly 70, 76 and/or a combination of both. Also, while the specific embodiments represented in FIGS. 11 through 14 of an indicator assembly 70 and 76 are specifically disclosed, other indicator assemblies may be provided which include the capability of activating an alarm of the type set forth above.

Referring now to FIGS. 15-18, yet another embodiment of the present invention comprises a stabilizer 480 disposable in an at least partially supporting relation with the locking member 454. In particular, the stabilizer 480 is structured to dispose the locking member 454 into and out of the offset angular orientation described in detail above, and in at least one embodiment, is movably disposable out of the supporting relation with the locking member 454. For instance, the stabilizer 480 of at least one embodiment is disposable between an operative, supporting orientation (FIG. 15) and a collapsed, non-supporting orientation (FIG. 18) relative to the locking member 454. In order to facilitate disposition from the operative, supporting orientation to the collapsed, non-supporting orientation, the stabilizer 480 of at least one embodiment further comprises an at least partially attenuated segment 482. The attenuated segment 482 may comprise, for instance, a structurally thinned out portion or hinge-like mechanism, for example, disposed between a supporting portion 481 and a collar 483.

While disposed in the operative, supporting relation as illustrated in FIG. 15, the stabilizer 480 is structured to at least partially support one end 454' of the locking member 454, while the supporting platform 460 is structured to support an oppositely disposed end 454" so as to position the locking member 454 in the offset angular orientation. As discussed above, when the locking member 454 is positioned in the offset angular orientation, the locking assembly 450 is disposed in a movement restricting engagement with the connector member 438.

In at least one embodiment, the stabilizer 480 comprises a substantially circular configuration (illustrated in FIG. 16), and is disposed in a substantially surrounding relation to at least a portion of the connector member 438. In at least one embodiment, as illustrated in the top view of FIG. 16, and the cross-sectional view of FIG. 17, at least one embodiment of the stabilizer 480 comprises at least one supporting portion 481, and a collar 483 and/or other base portion which may comprise a circular or ring-like configuration. The supporting portion 481 is disposable between a supporting and non-supporting orientation relative to the locking member 454, as described above, whereas the collar 483 is structured and disposed to facilitate mounting and balancing of the stabilizer 480 within the attachment member 436.

As described in detail above, various embodiments of the present invention further comprise a detachment assembly structured to dispose the locking assembly 450 out of the movement restricting engagement with the connector member 438. In at least one embodiment, the detachment assembly comprises at least one detachment structure 488 disposable in an impacting or engaging relation with the stabilizer 480 so as to dispose the stabilizer 480 from the operative, supporting orientation, and into the collapsed, non-supporting orientation. The detachment assembly of at least one embodiment may comprise a plurality of detachment structures 488, each disposable in an impacting and/or engaging relation with a different portion of the stabilizer 480 and/or connector member 438, as illustrated in FIG. 18.

In at least one embodiment, the stabilizer 480 is destructively disposed out of the supporting relation and into the collapsed, non-supporting orientation upon disposition of the at least one detachment structure 488 in an impacting or engaging relation with the stabilizer 480. For instance, the stabilizer 480 of at least one embodiment is structured to collapse, break, or hinge at the attenuated segment 482 upon being forced in the direction of arrow Al by the detachment structure(s) 488. Particularly, in at least one embodiment, a ledge 485 disposed within the attachment member 436 proximate the attenuated segment 482 may facilitate movement of the supporting portion 481 away from the locking member 454 and toward the collar 483 in the direction of arrow A2 so as to dispose the stabilizer 480 into the collapsed, non-supporting orientation.

Figure 18:
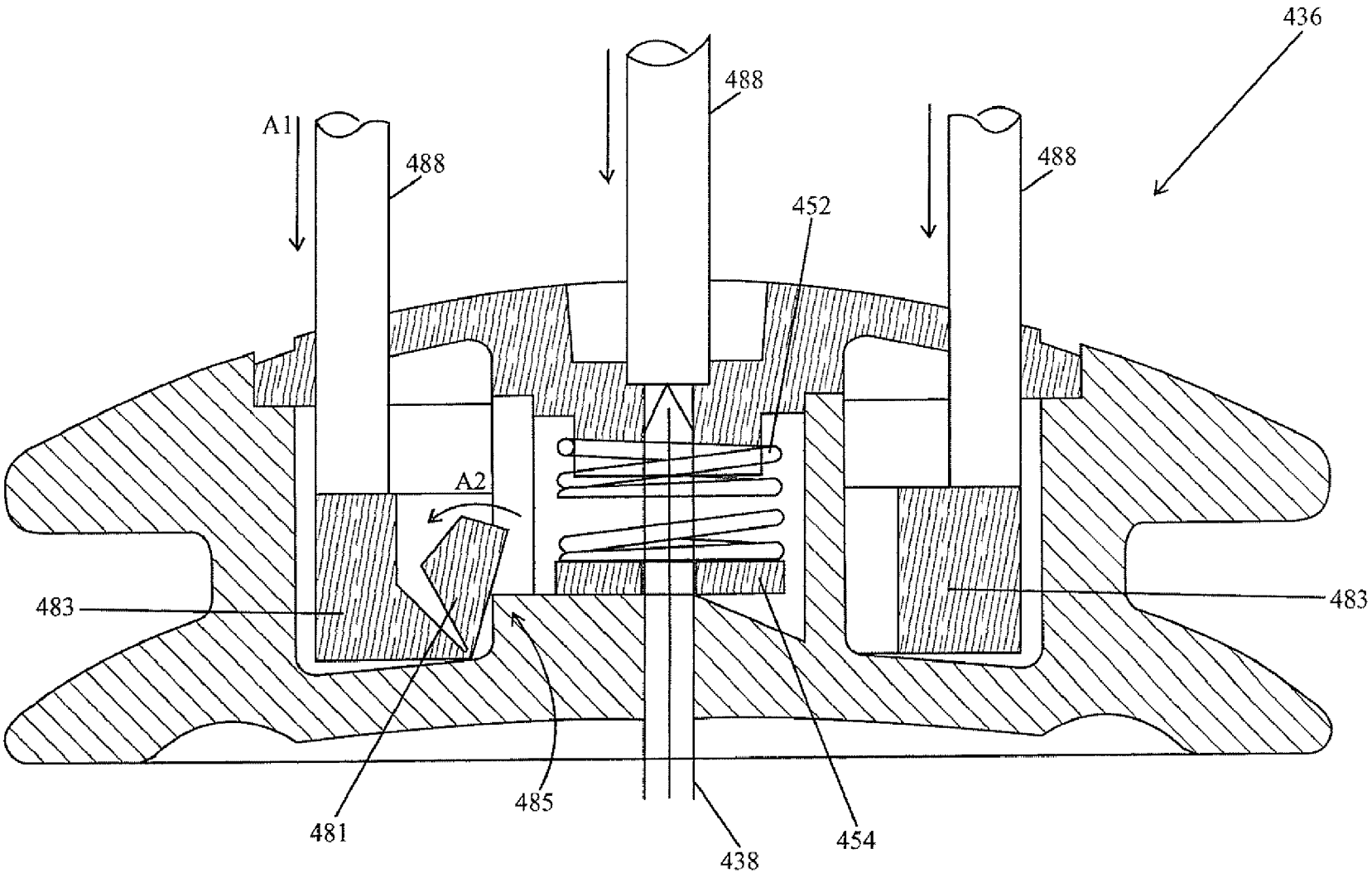
FIG. 18 is a sectional view of the attachment assembly illustrated in FIG. 17.
Figure 19:
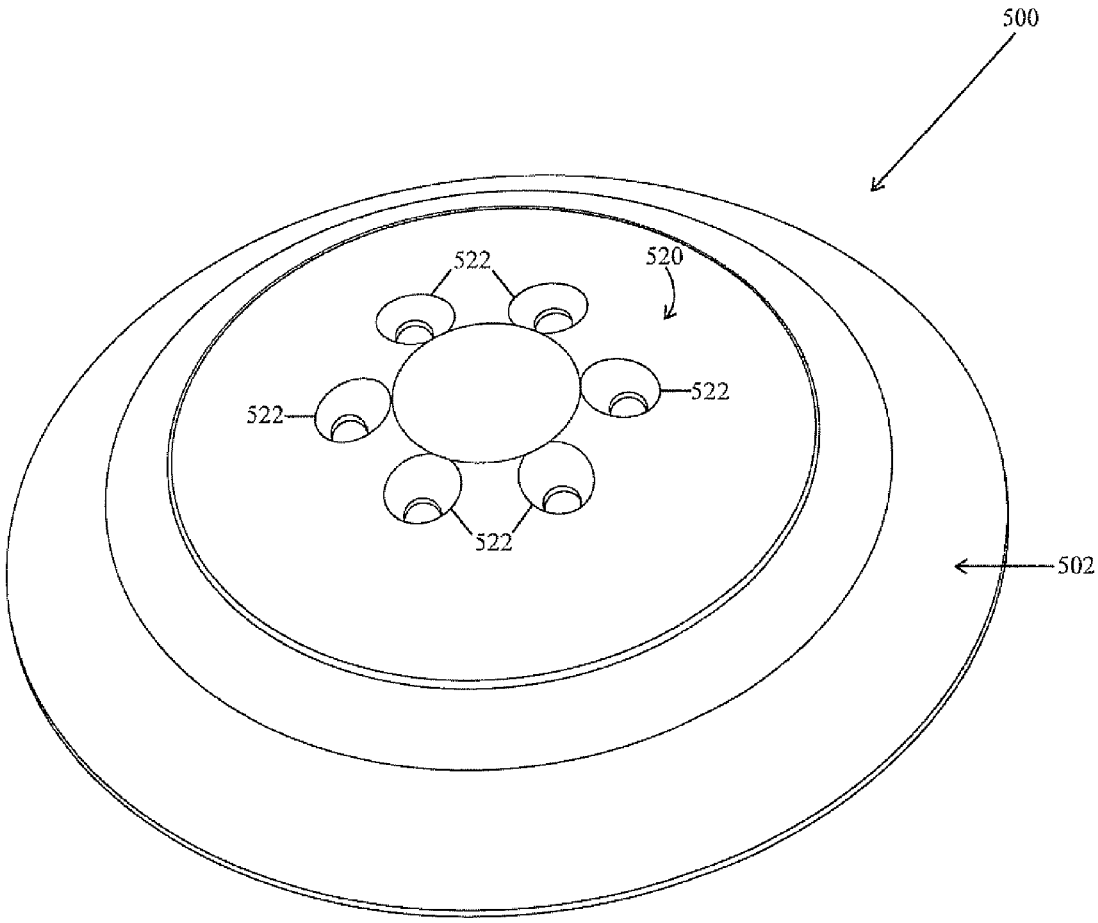
FIG. 19 is a perspective view of yet another preferred embodiment of a security tag assembly of the present invention.

Once the stabilizer 480 is disposed out of the supporting relation, as illustrated in FIG. 18, the locking member 454 is positioned from the locked orientation to a released orientation. The released orientation of the locking member 454 of at least one embodiment is defined as being disposed in a substantially perpendicular orientation relative to the longitudinal axis 439 of the connector member 438. With the stabilizer 480 positioned in a non-supporting orientation to the locking member 454, the positioning member 452 is structured to force or facilitate disposition of the locking member 454 in a substantially perpendicular orientation to the connector member 438. While the locking member 454 is disposed in this released or substantially perpendicular orientation, the connector member 438 may thus pass through the locking member 454 with minimal or no contact with the internal peripheral surfaces thereof.

FIGS. 19-24, represent yet another preferred embodiment of the present invention including a security tag assembly generally indicated as 500. The security tag assembly 500 includes a base 502 having an at least partially hollow interior 504 of sufficient dimension and configuration to house a plurality of operative components structured to facilitate the authorized attachment and release of a tag member, generally indicated as 506. The tag member 506 includes an elongated attachment pin 508, which not only serves to removably secure the tag member 506 to the base 502 but also serves to facilitate attachment of the security tag assembly 500 to various types of merchandise as discussed with reference to the embodiments of FIGS. 1-14, set forth above. More specifically, the attachment pin 508 is of sufficient length and structure to penetrate various types of merchandise including, but not limited to, garments or the like. After penetration, the attachment pin 508 passes into the interior 504 of the base and into a locking position relative to a locking assembly 510.

Figure 20:
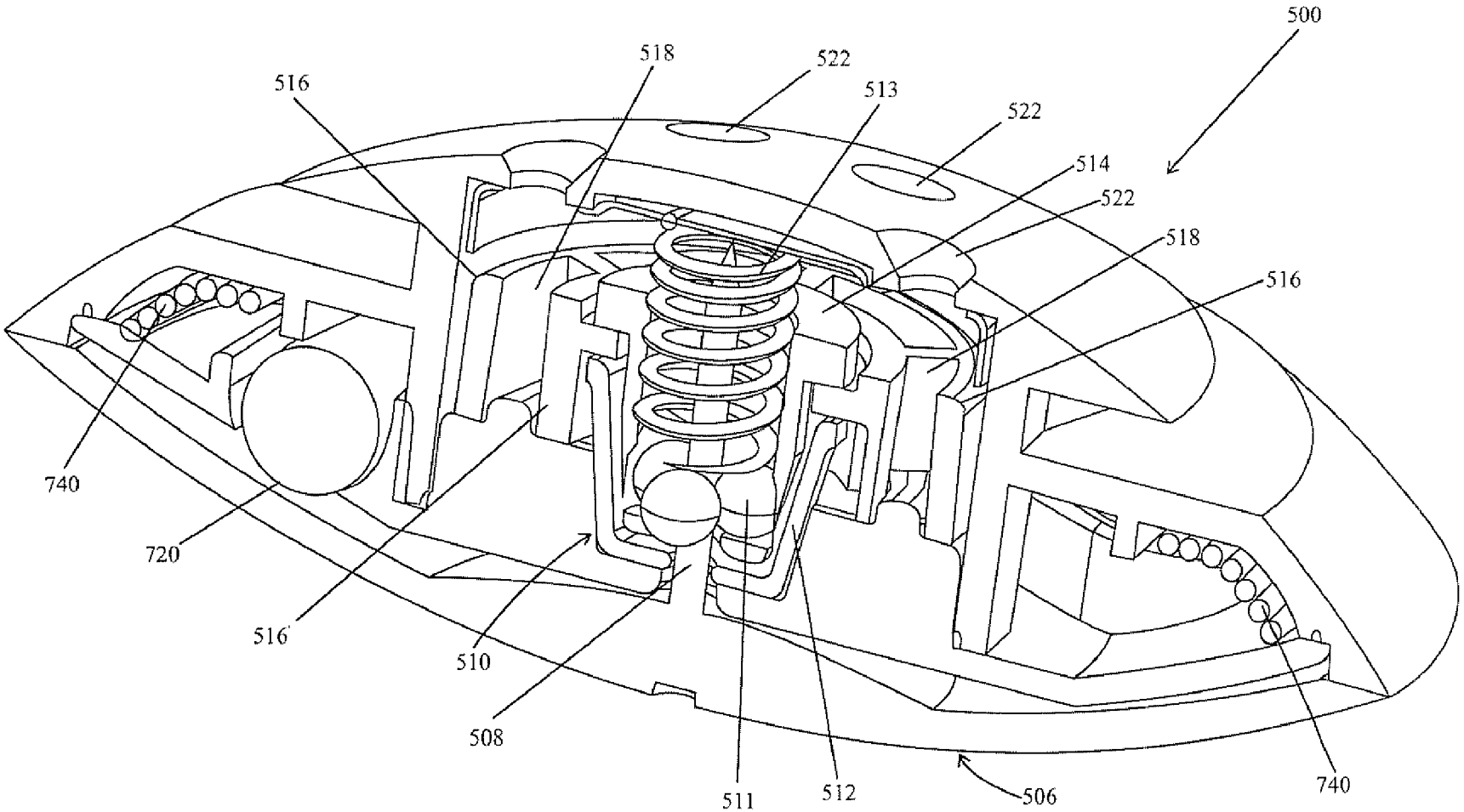
FIG. 20 is an interior sectional view in perspective of the embodiment of FIG. 19.
Figure 21:
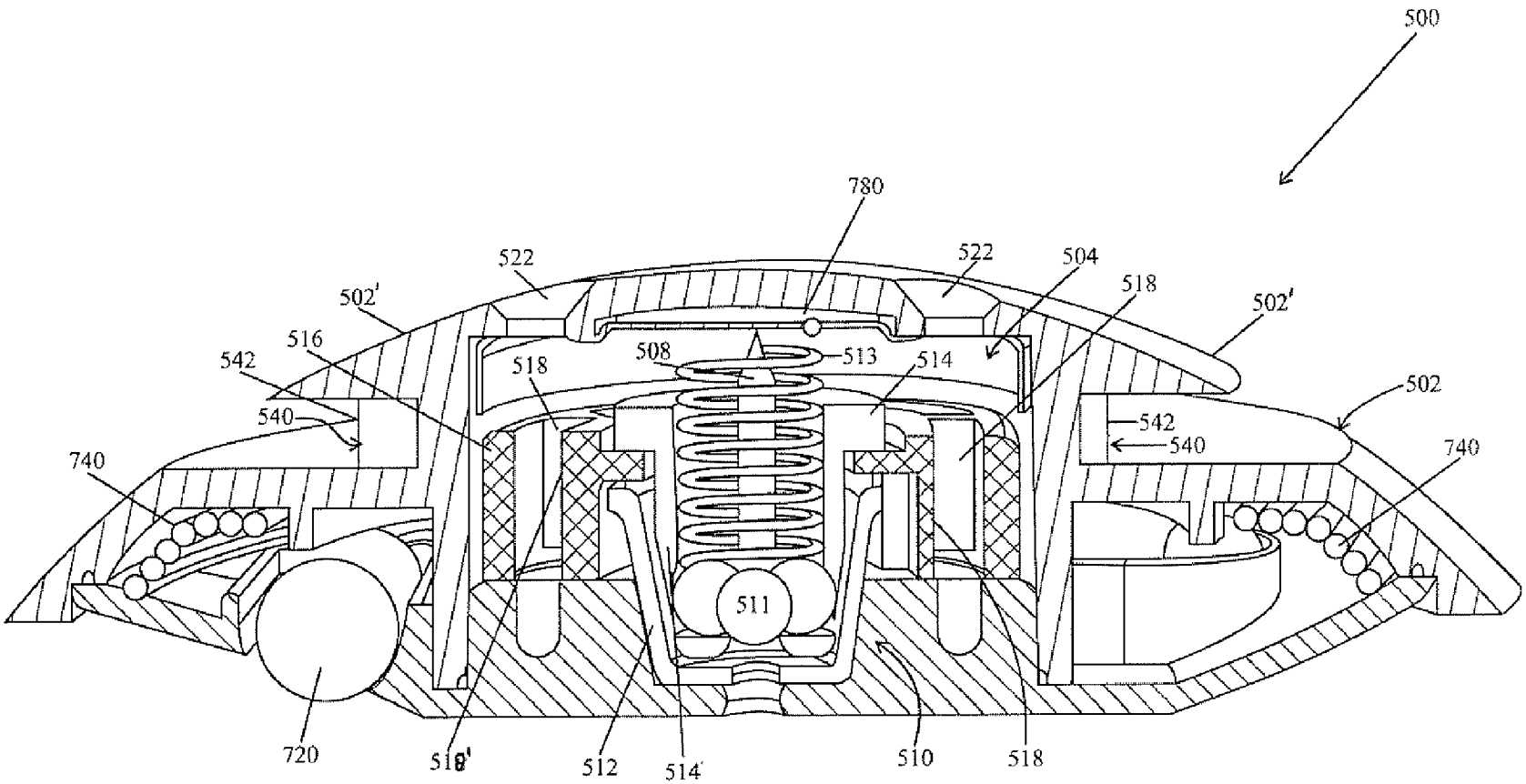
FIG. 21 is an interior sectional view in at least partially assembled form of the embodiment of FIGS. 19 and 20.
Figure 22:
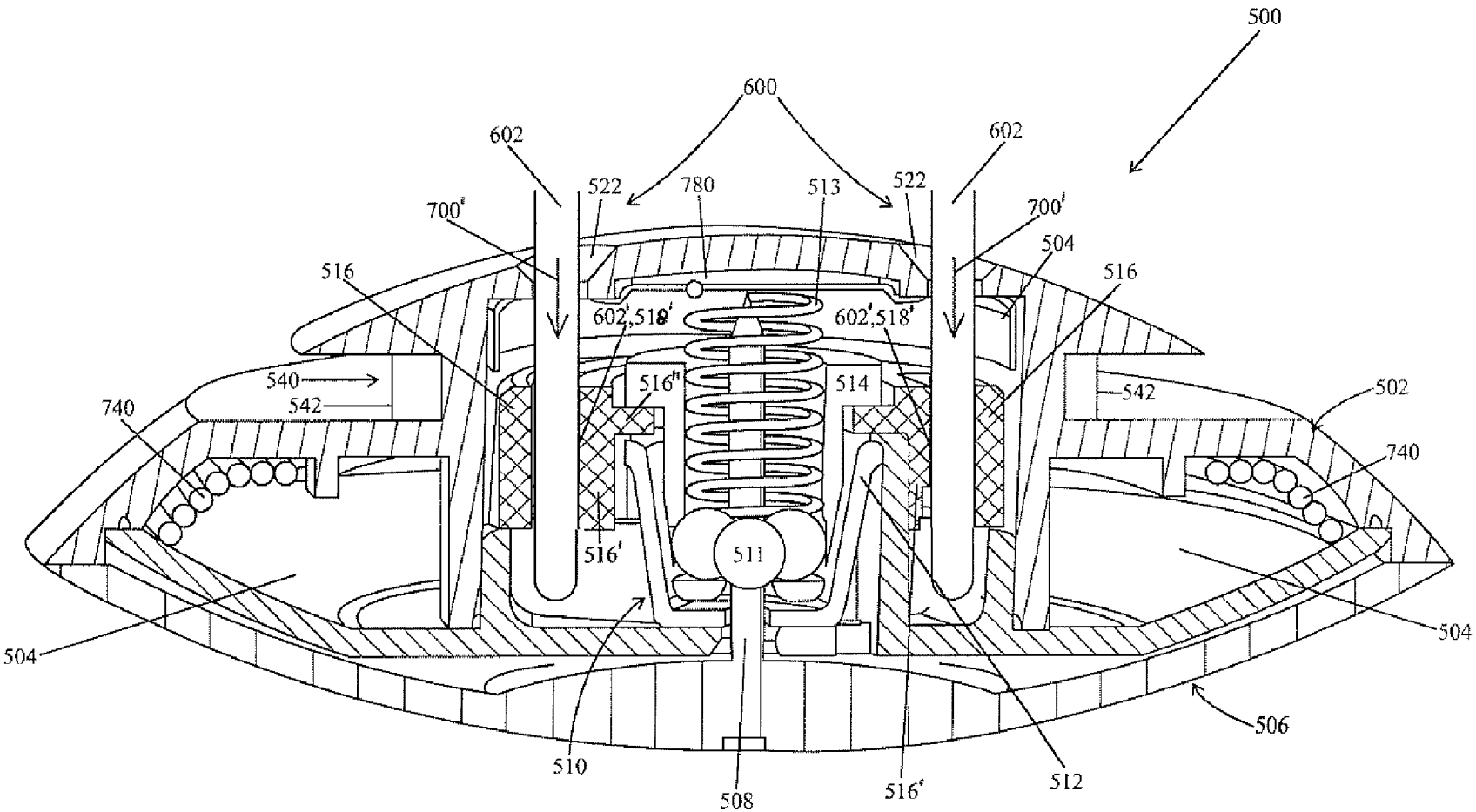
FIG. 22 is an interior sectional view of the embodiment of FIGS. 19 through 21 in an assembled form and in receiving, interacting relation to an externally applied detachment assembly.

The locking assembly 510 may be of conventional or customized structure. As represented throughout FIGS. 20-23, the locking assembly includes a plurality of locking members such as ball-type lock members 511 disposed on the interior of a retaining casing 512. In addition, a biasing member 513 serves to bias the locking members 511 into confronting, locking engagement with the exterior of the attachment pin 508 and thereby assume a locking orientation of the locking assembly 510. In addition, the locking assembly 510 also includes the retention structure 514 disposed in an exterior, at least partially surrounding relation to the biasing member or spring 513 and in retaining relation to the locking members 511 as at 514'. As a result of the force exerted on the lock members 511 by the biasing member 513 and the portion 514' of the retention member 514, the plurality of locking members 511 will be forced into the locking orientation and locking engagement with the exterior surface of the attachment pin 508, as set forth above. Accordingly, the locking assembly 510 can therefore be said to be normally biased into the locking orientation as represented in FIGS. 20-22.

Figure 23:
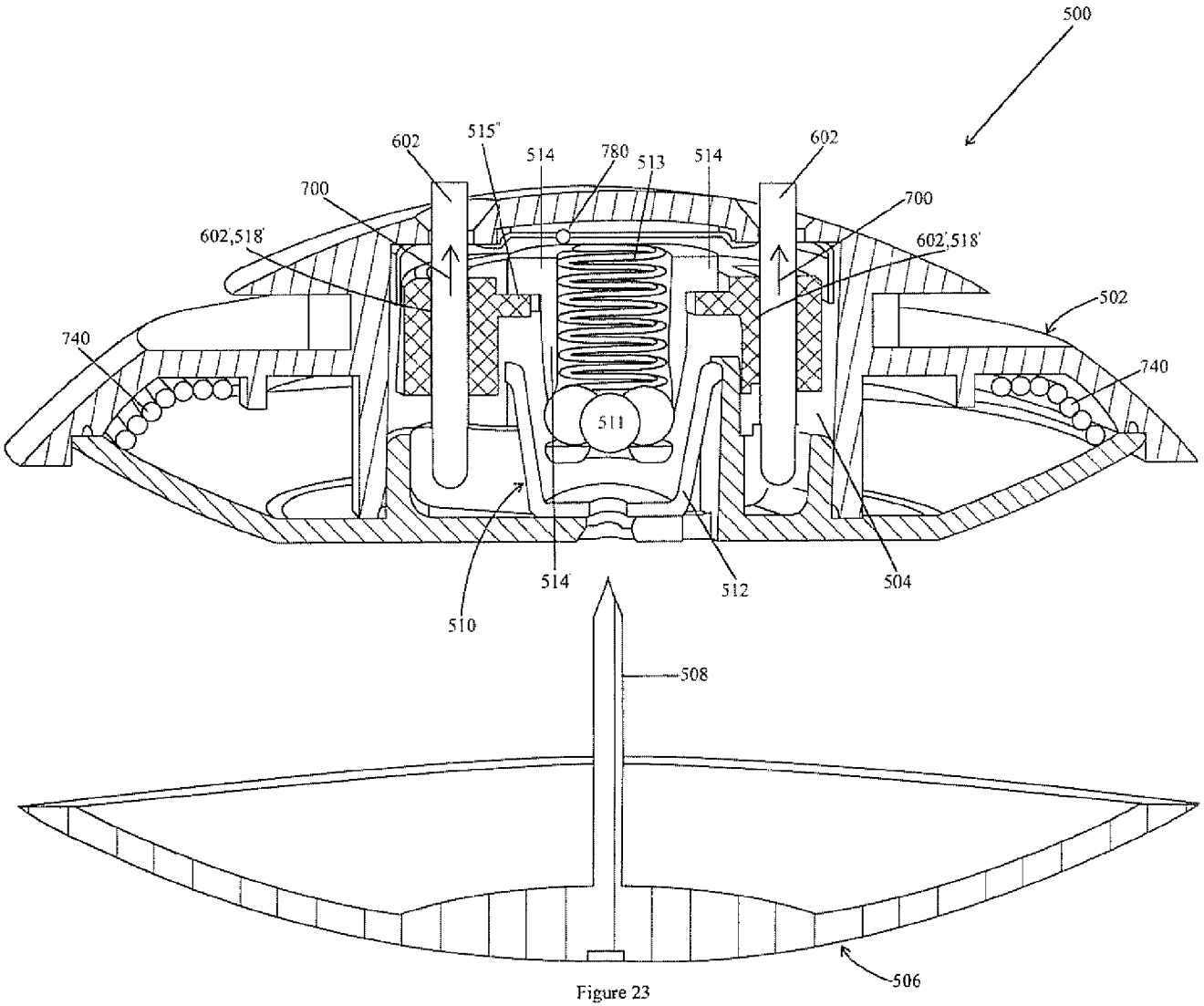
FIG. 23 is a composite interior sectional view of the embodiment of FIG. 22, wherein a tag member associated therewith is being removed.

Additional features of the security tag assembly 500 include a release member 516 disposed in at least partially surrounding relation to the locking assembly 510 and in engaging relation to at least a portion of the locking assembly 510 such as, but not limited to, the retention member 514. The release member 516 includes a plurality of channels, openings or passages 518 formed in and extending along a generally curved or annular configuration of the release member 516. The channels or passages 518 will be used to facilitate the authorized release of the tag member 506 from the base and the disposition of the locking assembly 510 out of the locking orientation which is represented in FIGS. 20 and 22. Such authorized release and/or removal of the tag member 506 can be accomplished by utilization of an authorized, externally applied detachment assembly, generally and at least partially indicated as 600, as schematically represented in FIGS. 22 and 23. The detachment assembly 600 includes at least one but preferably at least a plurality of two detachment members 602 as will be described in greater detail hereinafter.

In order to further facilitate the authorized release of the tag member 506 from the base 502, due to the interaction of the attachment assembly 600 with the release member 516, the base 502 further includes an access assembly 520 comprising a plurality of accessing openings 522. Each of the plurality of access openings 522 is disposed in communicating relation with the interior 504 of the base. In addition, at least some of the access openings 522 are disposed in at least partially aligned relation with one or more of the receiving channels 518. As a result of such an at least partial alignment, the passage of the detachment members 506 through access openings 522 will result in at least a portion of the detachment members 602 coming into interacting, confronting engagement with the release member 516. More specifically, passage of the one or more detachment members 602 through corresponding ones of the access openings 522 will result in disposition of the detachment members 602 into corresponding ones, but at least minimally off-set, relative with the channels 518 which are at least partially aligned with the access openings 522, as clearly demonstrated in FIG. 22.

Cooperative structures, dimensions and disposition of the detachment members 602 and the release member 516 define an at least partial misalignment of the receiving channels 518 and the length of the detachment members 602, received therein. Such an at least partial misalignment results in a somewhat frictional, confronting engagement of corresponding surfaces, as at 602' and 518', clearly represented in FIGS. 22 and 23. This frictional, confronting engagement can be more specifically and accurately described as a "gripping engagement" as opposed ones of the detachment member 602 pass into oppositely disposed receiving channels 518 and collectively serve to sandwich the interior portion 516' of the release member 516 between the cooperatively disposed detachment members 602.

With primary reference to FIG. 23, such a frictional, gripping engagement between the detachment member 602 and release member 516, due to interaction of the corresponding surfaces 602' and 518', will facilitate an outwardly directed pulling or lifting force being exerted on the movably disposed release member 516 as schematically represented by the directional arrows 700 represented in FIG. 23. Therefore, when such an outwardly directed pulling force 700 is exerted on the detachment assembly 600, the detachment member 602 will be directed in an outward direction relative to the interior 504 of the base 502. Such an externally applied, outwardly directed forced movement 700 of the detachment members 602 will result in release member 516 being forced into a "displacing engagement" with the locking assembly 510. More specifically, an annular lip or projection 516"of the release member 516 moves within the interior 504 in confronting relation with the retention member 514, forcing the locking assembly out of the locking orientation.

Therefore, the outwardly directed force 700 will cause an outwardly directed movement of the detachment member 602, causing the release member 516 to travel with the detachment members 602 into a displacing, driving engagement with the retention member 514. In turn, this displacing engagement will release and/or reduce the biasing force exerted on the locking members or balls 511 due, in part, to the retaining portion 514' being displaced outwardly or away from the locking members 511, as well as the displacement of the locking members 511 at least partially out of the interior of the casing 512 of the locking assembly 510. As a result, the locking balls or members 511 and the locking assembly 510 will be forced out of the locking orientation relative to the attachment pin 508, as represented in FIG. 23. Once the locking assembly 510 is out of the locking orientation, the tag member 506 can be removed from the base 502 by passage of the attachment pin 508 from the interior 504 of the base 502. This in turn, will result in a removal of the security tag assembly 500 from the garment or other product which was initially or originally connected to the security tag assembly 500.

Yet additional structural features of the security tag assembly 500 include an alignment assembly generally indicated as 540. The alignment assembly 540 extends at least partially or completely about the indicated exterior, accessible portion of the base 502. Moreover, the alignment assembly 540 is disposed, dimensioned and configured to be correctly oriented in a detachment assembly 600 or other support structure, generally indicated as 604 in FIG. 24. More specifically, the alignment assembly 540 may include an exterior surface 542 having a predetermined configuration and/or dimension to be received within a receiving assembly 606 associated with the support structure 604 or detachment assembly 600. As indicated the detachment assembly 600 and the support structure may be combined or be operatively and structurally independent.

In operation, the upper portion 502' of the base 502 passes along and into a trough or like receiving area 608. When so disposed, the predetermined exterior surface 542 of the alignment assembly 540 will be forced into a "correct" or predetermined alignment with the receiving ledge, lip or flange 606. The predetermined exterior surface configuration 542 cooperates with the dimension and configuration of the lip or ledge 606 so as to properly align the access assembly 520 and specifically the access openings 502 with the plurality of detachment member 602 (not represented in FIG. 24). By way of example, the exterior surface 542 of the alignment assembly 540 may include any of a variety of multi-sided or other appropriate configurations which, when disposed within and engaging the lip or receiving portion 606, will serve to automatically align at least some of the plurality of access openings 522 with the detachment members 606.

Figure 24:
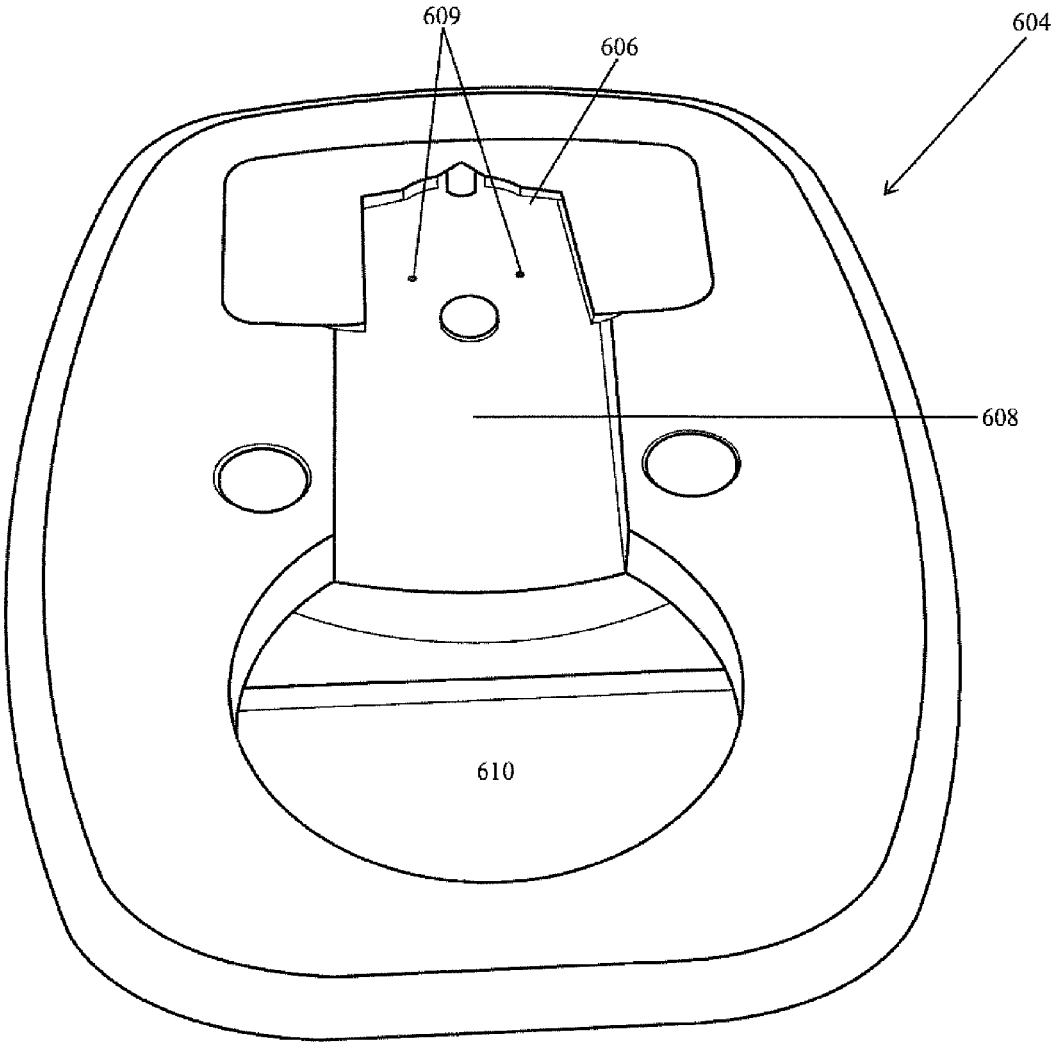
FIG. 24 is a perspective view of at least a portion of a detachment assembly absent representation of the detachment members as represented in FIGS. 22 and 23.

Further with regard to FIG. 24, the detachment members 602 may pass through the apertures or openings 609 in the receiving area 608 and into and through the aligned access openings 522, into the interior 504 of the base 502 and into gripping engagement with corresponding surfaces 518' of the receiving channels 518, as schematically represented as 700' in FIG. 22. Once the outwardly directed pulling force 700 is exerted on the detachment members 602, the release member 516 will be forced into displacing engagement with the retention member 514, as set forth above, allowing the tag member 506 to be separated from the base 502 in an authorized manner. Once released, the tag member 506 may pass through the opening 610 of the support structure 604. It is emphasized that support structure 604, as represented in FIG. 24, may assume a variety of different structures and configurations and, as also set forth above, may include or be directly associated with a detachment assembly 600 due to the interaction with the downward and upward movement of the detachment member 602 as schematically represented by directional arrow 700' and 700.

As also represented throughout the Figures, other structural features of at least one of the preferred embodiments of the security tag assembly 500 may include ink cartridges 720 provided on the interior 504 of the base 502. As is known in the security tag industry, the provision of breakable ink cartridges 720 serves to stain or otherwise mark a garment or other product to which the security tag assembly 500 is attached, such as when the security tag assembly 500 and the tag member 506 are physically forced out of connecting engagement with one another.

Yet additional structural and operative features of at least one preferred embodiment of the security tag assembly 500 of the present invention includes the provision of a coil or other appropriate structure 740, which includes alarm activating capabilities and/or radio frequency signaling capabilities. As such, coil or like structure 740 is mounted within the interior 504 of the base 502 in a preferably, non-accessible location. Depending upon the embodiment utilized the coil or other RF signaling structure 740 may also have data storage capabilities. Therefore, the provided RF signaling structure may be utilized to automatically provide inventory, purchase, location, origin of supplier or manufacturer or other merchandise data relating to the product to which it is attached. Such merchandise data may be transmitted by wireless communication with appropriate receiving facilities (not shown for purposes of clarity) associated with a cash register or other check-out facilities. The RF signaling structure 740 may also be capable of activating alarm facilities such as those located at the entrance or other location of the store where the products are sold.

Yet additional structural features included in the embodiment of FIGS. 19-23 which serve to prevent or restrict the unauthorized separation of the base 502 and tag member 506 include the provision of a burn shield 780 or like structure. More specifically, burn shield 780 is disposed in at least partially covering, surrounding and/or other protecting relation to operative components within the interior of the base 502. Such operative components include, but are not limited to, the locking assembly 510, the retention member 514, the release member 516, etc. as represented in FIGS. 21-23. The burn shield 780 is formed of an appropriate fire resistant material and is disposed to shield and otherwise protect access to and/or destruction of the locking assembly and other interior components by a flame or heat source applied to the exterior of the base 502 such as at, but not limited to, the outer portion 502' thereof.

Figure 25:
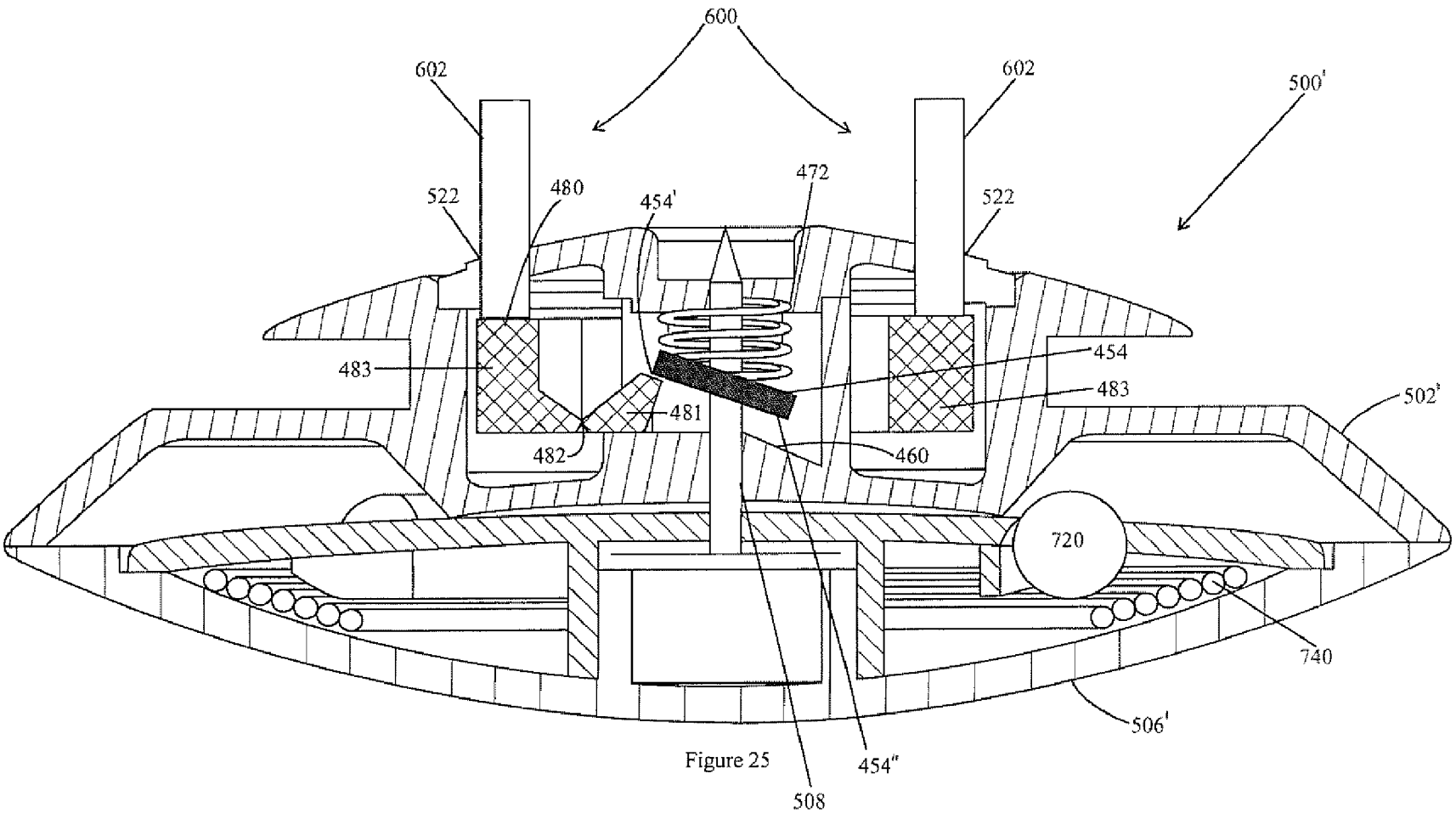
FIG. 25 is a yet another preferred embodiment of the security tag assembly of the present invention interacting with a detachment assembly of the type represented in FIGS. 22 and 23.
Figure 26:
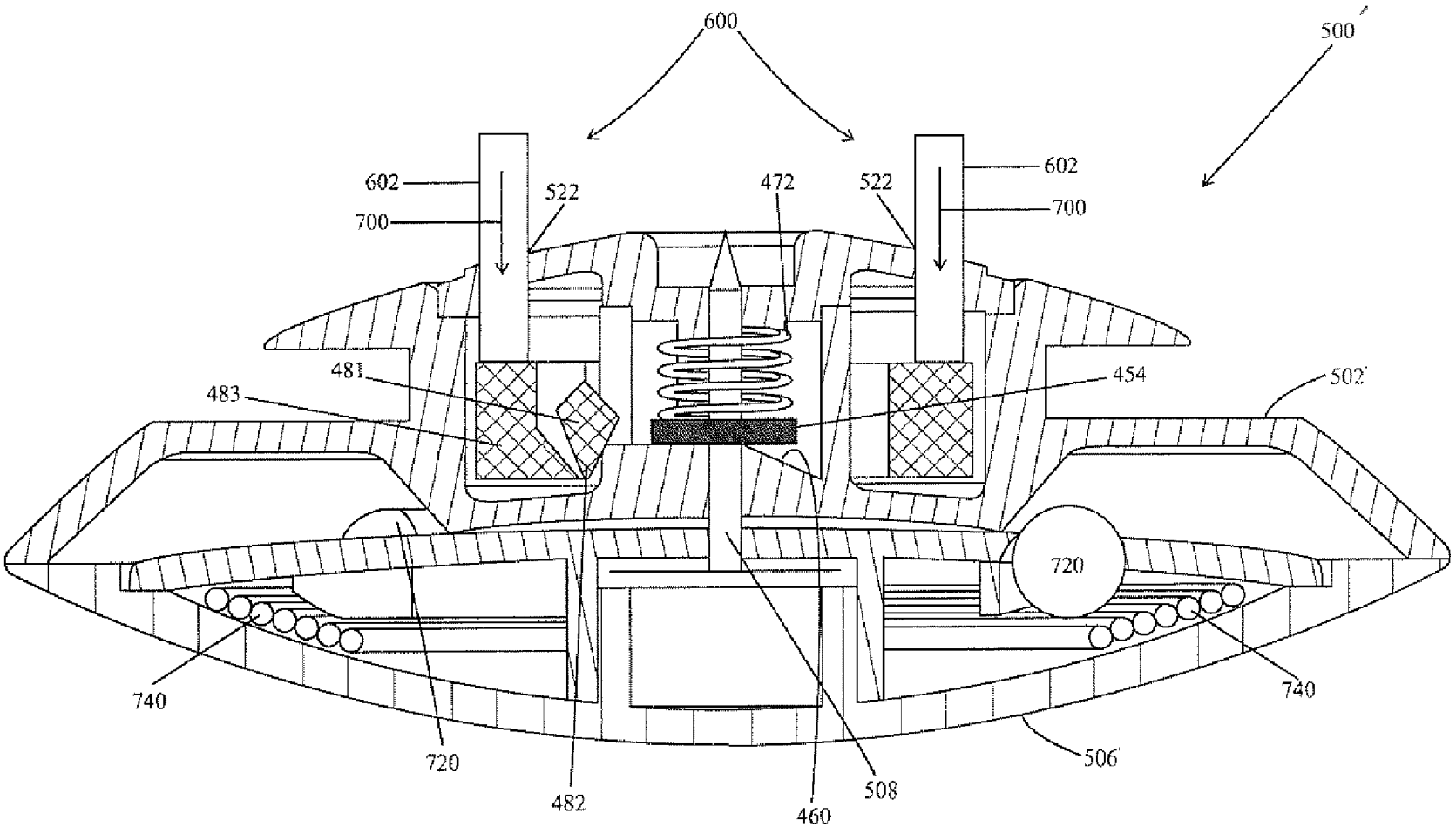
FIG. 26 is an interior sectional view of the embodiment of FIG. 25 wherein a locking assembly associated therewith out of a locking orientation.

FIGS. 25 and 26 relate to a structural modification of the security tag assembly 500' wherein coil members 740 is located in the tag member 506' having the attachment pin 508 secured thereto. The base 502' includes a release member in the form of stabilizer 480 structured to dispose a locking member 454 into and out of an offset angular orientation, defining the locking orientation, relative to the attachment pin 508. As set forth in greater detail herein with regard to the embodiment of FIGS. 17 and 18, stabilizer or release member 480 is disposable between an operative, supporting orientation as represented in FIG. 25 and a collapsed, non-supporting orientation as represented in FIG. 26, relative to locking the attachment pin 508. In order to facilitate disposition from the operative, supporting orientation or "locking orientation" to the collapsed, non-supporting orientation, the stabilizer 480, of at least one embodiment of the present invention, further comprises an at least partially attenuated segment 482. The attenuated segment 482 may comprise a structurally dimensioned "area" of reduced thickness which may define a somewhat hinge-like mechanism. The attenuated segment 482 may comprise by, way of example only, a portion which is reduced in thickness and which is disposed between a supporting portion 481 and a collar 483.

When disposed in the locking orientation as represented in FIG. 24, the stabilizer and/or release member 480 is structured to at least partially support one end 454' of the locking member 454 while the supporting platform 460 is structured to support an oppositely disposed end 454" thereby disposing the locking member 454 in the offset angular orientation. In order to accomplish authorized removal of the tag member 506' from the base 502', the detachment assembly 600, including the detachment members 602, is moved downwardly from the access openings 522, formed in the base 502 into forced engagement with the collar 483. Movement of the detachment members 602 will be accomplished with sufficient force and along a sufficient distance to cause a detachment, breaking or pivoting of the at least one supporting portion 481 along the attenuated segment 482 as indicated by directional arrow 82 in FIG. 18. The locking member 454 will then be disposed out of the locking orientation relative to the attachment pin 508 thereby facilitating the separation of the tag member 506' from the base 502' of the security tag assembly 500'.

Therefore, the various preferred embodiments of the security tag assembly 500, 500' of the present invention overcomes many of the problems and disadvantages associated with the conventional or previously known security systems and/or security tag assemblies.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security tag assembly structured to restrict unauthorized removal of a product from an area, said security tag assembly comprising:

a base including a locking assembly, said locking assembly structured to be biased into a locking orientation, a tag member including an elongated attachment pin structured to pass through the product into a locking position, said locking position comprising said attachment pin passing into said base and into removable locking engagement with said locking assembly when in said locking orientation, a release member movably disposed within said base and structured for gripping engagement with an externally applied detachment assembly, said release member disposed into a displacing engagement with at least a portion of said locking assembly upon said gripping engagement of said release member with the detachment assembly, and said gripping engagement being at least partially defined by sufficient frictional engagement between said detachment assembly and said release member to maintain an outwardly directed pulling force on said release member at least until said locking assembly is out of said locking orientation.

2. A security tag assembly as recited in claim 1 wherein said base comprises an access assembly disposed and configured to facilitate passage of the detachment assembly therethrough into said gripping engagement with said release member.

3. A security tag assembly as recited in claim 1 wherein said release member is disposed and configured to establish said gripping engagement with a plurality of detachment members defining said detachment assembly.

4. A security tag assembly as recited in claim 3 wherein said base comprises an access assembly disposed and configured to facilitate passage of the detachment assembly therethrough into said gripping engagement with said release member; said access assembly comprising a plurality of access openings formed in said base and disposed and dimensioned to facilitate passage of said plurality of detachment members therethrough into said gripping engagement with said release member.

5. A security tag assembly as recited in claim 4 wherein said release member includes a plurality of receiving channels, at least two of said plurality of receiving channels being disposed and configured with at least two of said plurality of detachment members to facilitate said gripping engagement with said at least two detachment members.

6. A security tag assembly as recited in claim 5 wherein at least two of said plurality of access openings are disposed in aligned relation with said at least two receiving channels.

7. A security tag assembly as recited in claim 3 wherein said release member comprises a plurality of receiving channels each disposed to receive a different one of said plurality of detachment members therein.

8. A security tag assembly as recited in claim 7 wherein said plurality of receiving channels are cooperatively disposed and configured with the plurality of detachment members to facilitate said gripping engagement with correspondingly disposed ones of said detachment members.

9. A security tag assembly as recited in claim 7 further comprising an alignment assembly disposed in an exteriorly accessible location on said base, said alignment assembly structured to facilitate alignment between at least some of said plurality of access openings with the plurality of detachment members.

10. A security tag assembly structured to restrict unauthorized removal of a product from an area, said security tag assembly comprising:

a base including a biased locking assembly normally disposed in a locking orientation, a tag member including an elongated attachment pin disposable into removable locking engagement with said locking assembly, when said locking assembly is in said locking orientation, a release member movably disposed within said base in displacing engagement with said locking assembly, said release member structured for gripping engagement with a plurality of externally applied detachment members, said release member movably disposable to force said locking assembly out of said locking orientation relative to said attachment pin upon an outwardly directed, pulling force being exerted on said release member by the plurality of detachment members, and an alignment assembly accessibly disposed on said base and structured to facilitate alignment of said release member with the externally applied detachment members.

11. A security tag assembly as recited in claim 10 wherein said release member comprises a plurality of receiving channels each disposed to receive a different one of the detachment members therein.

12. A security tag assembly as recited in claim 11 wherein said base comprises a plurality of access openings disposed and dimensioned to facilitate passage of the plurality of the detachment members therethrough into said gripping engagement with correspondingly disposed ones of said receiving channels.

13. A security tag assembly as recited in claim 11 wherein said alignment assembly is disposed and structured to define alignment of at least some of said access openings and corresponding ones of said plurality of receiving channels with the plurality of detachment members.

14. A security tag assembly as recited in claim 11 wherein said gripping engagement is at least partially defined by a sufficient frictional engagement between the plurality of detachment members and at least some of said plurality of channels to exert said outwardly directed, pulling force on said release member at least until said locking assembly is out of said locking orientation.

15. A security tag assembly structured to restrict unauthorized removal of a product from an area, said security tag assembly comprising:

a base including a locking assembly, said locking assembly structured to be biased into a locking orientation, a tag member including an elongated attachment pin structured to pass through the product into a locking position, said locking position comprising said attachment pin passing into said base and into removable locking engagement with said locking assembly when in said locking orientation, a release member movably disposed within said base and structured for movable engagement with an externally applied detachment assembly, said release member disposed into a displacing engagement with at least a portion of said locking assembly upon engagement of said release member with the detachment assembly; said detachment assembly including a plurality of detachment members, said base comprising a plurality of access openings disposed and dimensioned to facilitate passage of said plurality of detachment members therethrough into said gripping engagement with correspondingly disposed ones of a plurality of receiving channels, at least two of said plurality of receiving channels comprising an at least partially offset relation to a length of corresponding ones of said detachment members, and said displacing engagement sufficient to dispose said locking assembly out of said locking orientation relative to said attachment pin.

16. A security tag assembly as recited in claim 15 wherein at least some of said plurality of access openings are disposed in at least partially aligned relation with at least some of said plurality of receiving channels.

17. A security tag assembly as recited in claim 15 wherein at least two of said plurality of receiving channels are cooperatively disposed and configured with said plurality of detachment members to facilitate said gripping engagement with different ones of correspondingly disposed detachment members.

18. A security tag assembly as recited in claim 17 wherein said at least two receiving channels are disposed in diametrically opposed relation to one another.

19. A security tag assembly as recited in claim 15 wherein said predetermined configuration of said alignment assembly comprises a multi-sided peripheral configuration.

20. A security tag assembly structured to restrict unauthorized removal of a product from an area, said security tag assembly comprising:

a base including a locking assembly, said locking assembly structured to be biased into a locking orientation, a tag member including an elongated attachment pin structured to pass through the product into a locking position, said locking position comprising said attachment pin passing into said base and into removable locking engagement with said locking assembly when in said locking orientation, a release member movably disposed within said base and structured for gripping engagement with an externally applied detachment assembly defined by a plurality of detachment members, said release member disposed into a displacing engagement with at least a portion of said locking assembly upon engagement of said release member with the detachment assembly, said displacing engagement sufficient to dispose said locking assembly out of said locking orientation relative to said attachment pin, said base comprising an access assembly including a plurality of access openings formed in said base and disposed and dimensioned to facilitate passage of said plurality of detachment members therethrough into said gripping engagement with said release member, said release member comprising a plurality of receiving channels each disposed in receiving relation to a different one of said plurality of said detachment members, an alignment assembly disposed in an exteriorly accessible location on said base, said alignment assembly structured to facilitate alignment between at least some of said plurality of access openings with said plurality of detachment members, and said alignment assembly including a predetermined disposition and configuration determinative of an aligned orientation of said base and said plurality of access openings relative to the plurality of detachment members.

* * * * *